US010481531B2

(12) United States Patent
Nagasaki et al.

(10) Patent No.: US 10,481,531 B2
(45) Date of Patent: Nov. 19, 2019

(54) IMAGE FORMING APPARATUS HAVING A SWITCHING MEMBER, A DETACHABLE UNIT, AND A RETRACTING MEMBER THAT RETRACTS THE SWITCHING MEMBER IN A COURSE OF DISMOUNTING THE UNIT

(71) Applicant: CANON KABUSHIKI KAISHA, Tokyo (JP)

(72) Inventors: Tsuyoshi Nagasaki, Tokyo (JP); Satoshi Murasaki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/118,230

(22) Filed: Aug. 30, 2018

(65) Prior Publication Data

US 2019/0072885 A1 Mar. 7, 2019

(30) Foreign Application Priority Data

Sep. 6, 2017 (JP) ..... 2017-170879
Jun. 20, 2018 (JP) ..... 2018-117473

(51) Int. Cl.
*G03G 15/20* (2006.01)
*G03G 15/00* (2006.01)
(Continued)

(52) U.S. Cl.
CPC ..... *G03G 15/2028* (2013.01); *G03G 15/0865* (2013.01); *G03G 15/1615* (2013.01); *G03G 15/2035* (2013.01); *G03G 15/2064* (2013.01); *G03G 15/602* (2013.01); *G03G 21/1638* (2013.01); *G03G 15/234* (2013.01)

(58) Field of Classification Search
CPC ..... G03G 15/2028; G03G 15/2035; G03G 21/1638; G03G 15/0865; G03G 15/602; G03G 15/2064; G03G 15/1615; G03G 15/234
See application file for complete search history.

(56) References Cited

U.S. PATENT DOCUMENTS 5,839,032 A 11/1998 Yasui et al.
2010/0034559 A1 2/2010 Sahara
2011/0044704 A1 2/2011 Uehara

FOREIGN PATENT DOCUMENTS

JP 07261471 A * 10/1995
JP H11-143153 A 5/1999
(Continued)

*Primary Examiner* — Susan S Lee
(74) *Attorney, Agent, or Firm* — Canon U.S.A. Inc., IP Division

(57) ABSTRACT

An image forming apparatus including an apparatus main body including an image forming device that forms an image on a recording material, a unit detachably mounted in the apparatus main body, a switching member pivotably provided in the apparatus main body, wherein while in a state in which the switching member has entered into the unit mounted in the apparatus main body, the switching member selectively switches a route through which the recoding material is guided, and a retracting member provided in the apparatus main body, wherein in a course of dismounting the unit from the apparatus main body, the retracting member retracts the switching member to an outside of a mount area of the unit.

11 Claims, 18 Drawing Sheets

(51) Int. Cl.

| | |
|---|---|
| ***G03G 15/16*** | (2006.01) |
| ***G03G 15/08*** | (2006.01) |
| ***G03G 21/16*** | (2006.01) |
| ***G03G 15/23*** | (2006.01) |

(56) References Cited

FOREIGN PATENT DOCUMENTS

| | | | | |
|---|---|---|---|---|
| JP | 2006293407 | A | * | 10/2006 |
| JP | 2014-130376 | A | | 7/2014 |
| JP | 2016-75752 | A | | 5/2016 |

* cited by examiner

IMAGE FORMING APPARATUS HAVING A SWITCHING MEMBER, A DETACHABLE UNIT, AND A RETRACTING MEMBER THAT RETRACTS THE SWITCHING MEMBER IN A COURSE OF DISMOUNTING THE UNIT

BACKGROUND OF THE INVENTION

Field of the Invention

The present disclosure relates to an image forming apparatus such as a copier or a printer that includes a switching member to selectively switch a route through which a recording material is guided, and a unit that is capable of being mounted and dismounted to and from an apparatus main body.

Description of the Related Art

Hitherto, an image forming apparatus such as a copier or a printer that includes a flapper to selectively switch a route through which a recording material is guided, and a fixing device that is capable of being mounted and dismounted to and from an apparatus main body has been proposed. An image forming apparatus adopting such a relationship between the flapper and the fixing device capable of being mounted and dismounted is known in Japanese Patent Laid-Open No. 2014-130376. Furthermore, Japanese Patent Laid-Open No. 2016-75752 describes an image forming apparatus that includes a fixing device that can be mounted and dismounted to and from an apparatus main body.

In other words, in view of the replaceability and ease of operation when paper is jammed, there is a need to facilitate mounting and dismounting of the fixing device mounted and dismounted to and from an image forming apparatus main body and the opening and closing unit without having to feel any stress.

Referring to FIGS. 17 and 18, a configuration described in Japanese Patent Laid-Open No. 2014-130376 will be described. As illustrated in FIGS. 17 and 18, a cover 200 is provided so as to be openable and closable with respect to an image forming apparatus. During the paper jam process and when replacing the fixing device, the cover 200 is opened as illustrated by broken lines in FIG. 18. Accordingly, in association with the opening movement of the cover 200, a flapper 202 situated downstream of a fixing device 201 in a conveyance direction of the recording material is freed from the restriction of an abutment portion 200*a* included in the cover 200, and moves to a retracted position. With the above, the fixing device 201 can be mounted and dismounted without coming into contact with the flapper 202.

Meanwhile, the weight of the image forming apparatus main body needs to be reduced by reducing the size of the image forming apparatus main body and simplifying the component configuration to save the installation space and to save energy during physical distribution.

However, as described in Japanese Patent Laid-Open No. 2014-130376, in a configuration in which the flapper 202 moves to the retracted position when the cover 200 is released, the abutment portion 200*a* for the flapper 202 to abut against the cover 200 is needed. In particular, in a case in which the flapper is disposed deep inside the image forming apparatus main body, the abutment portion also needs to be disposed at a position deep inside the image forming apparatus main body.

In other words, in the configuration in Japanese Patent Laid-Open No. 2014-130376, the pivoting locus of the cover 200 including the abutment portion 200*a* for the flapper 202 to abut against becomes large, and the size of the image forming apparatus main body becomes large. Furthermore, in order to make the pivoting locus smaller, a complex link configuration can be used; however, a large number of components will be required which leads to an increase in the weight of the image forming apparatus.

SUMMARY OF THE INVENTION

The present disclosure suppresses increase in a size and weight of an image forming apparatus main body.

The present disclosure provides an image forming apparatus including an apparatus main body including an image forming device that forms an image on a recording material, a unit detachably mounted in the apparatus main body, a switching member pivotably provided in the apparatus main body, wherein while in a state in which the switching member has entered into the unit mounted in the apparatus main body, the switching member selectively switches a route through which the recoding material is guided, and a retracting member provided in the apparatus main body, wherein in a course of dismounting the unit from the apparatus main body, the retracting member retracts the switching member to an outside of a mount area of the unit.

Further features of the present disclosure will become apparent from the following description of exemplary embodiments with reference to the attached drawings.

DESCRIPTION OF THE EMBODIMENTS

Figure 1:
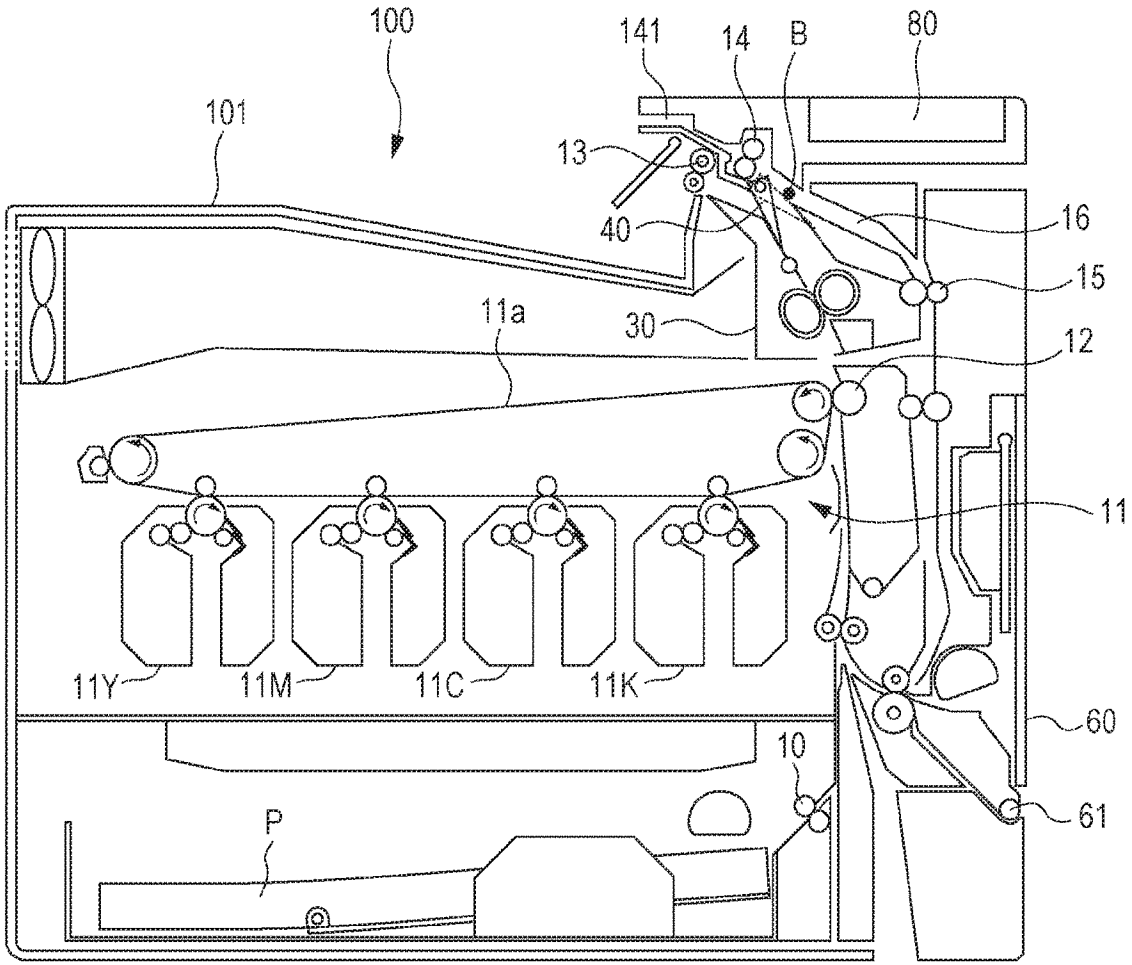
FIG. 1 is a schematic cross-sectional view illustrating an example of the image forming device.

Hereinafter, referring to the drawings, preferred embodiments of the disclosure will be exemplified in detail. Note that the dimensions, the materials, and the shapes of the components and the relative configuration of the components, and the like that are described in the following exemplary embodiment are to be appropriately changed based on the device, to which the present disclosure is applied, and various conditions. Accordingly, unless otherwise specified in particular, the scope of the present disclosure is not intended to be limited by the exemplary embodiment described below.

Figure 2:
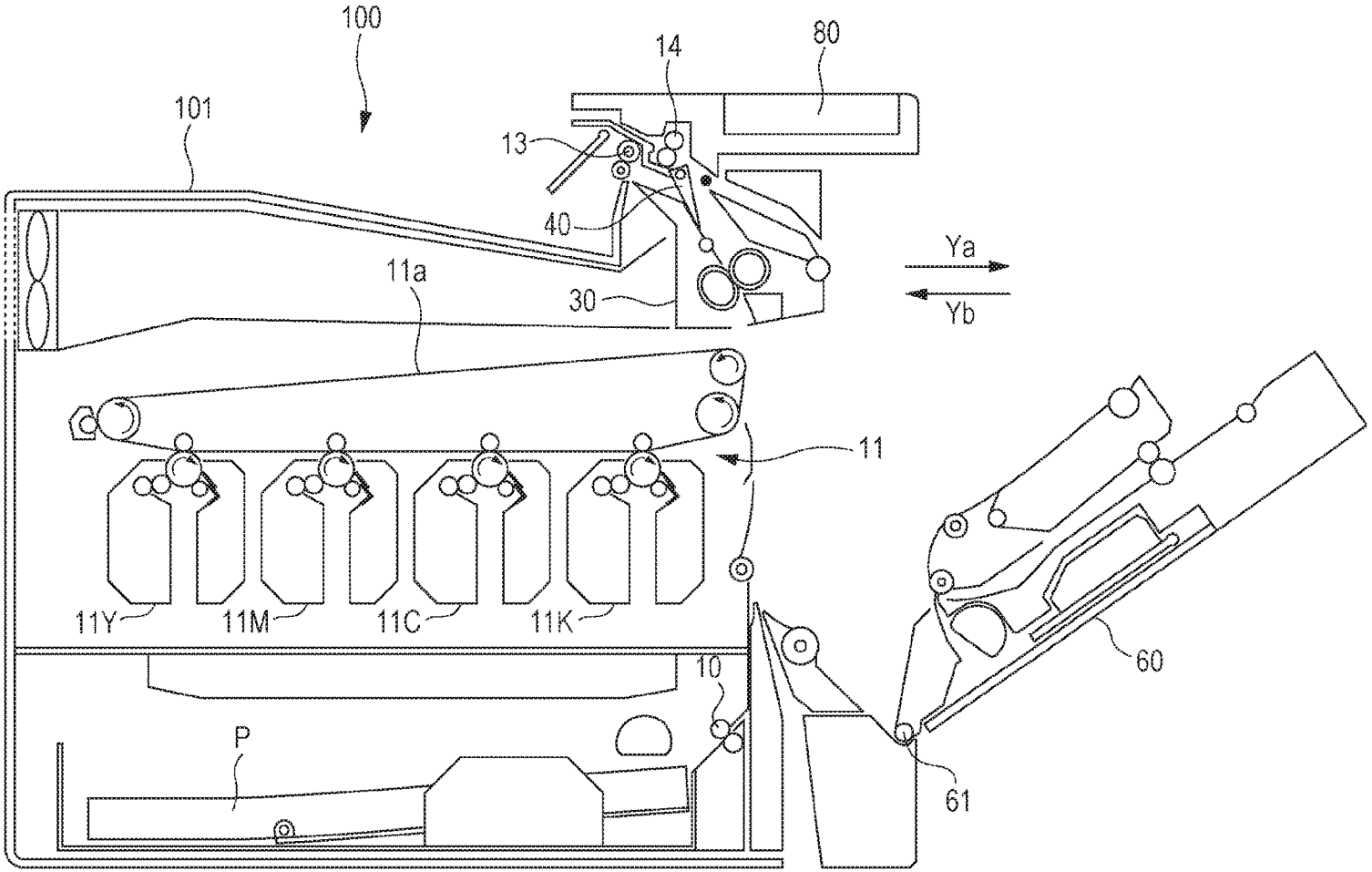
FIG. 2 is a schematic view of the image forming apparatus in which a right cover is open.

Referring first to FIGS. 1 and 2, an overall configuration of an image forming apparatus to which the present disclosure has been applied will be outlined. FIG. 1 is a schematic cross-sectional view illustrating an example of the image forming device. FIG. 2 is a schematic cross-sectional view of the image forming apparatus illustrated in FIG. 1 in which a right cover has been opened. Note that when viewing the image forming apparatus illustrated in FIG. 1 in a direction orthogonal to the sheet surface of FIG. 1, this side with respect to the sheet surface of FIG. 1 is referred to as the front side of the apparatus and that side with respect to the sheet surface of FIG. 1 is referred to as the rear side of the apparatus.

As illustrated in FIG. 1, an image forming apparatus 100 includes an apparatus main body 101 including an image forming device 11 that forms an image on a recording material P such as a sheet of paper, and a fixing device 30 that is detachable from the apparatus main body 101 and that fixes an image on the recording material P. The apparatus main body 101 includes a flapper 40 serving as a switching member that selectively switches the route (conveyance path) through which the recording material P is guided. The flapper 40 serving as the switching member is pivotably provided in the apparatus main body 101. The fixing device 30 according to the present exemplary embodiment is a unit that is detachably mounted in the apparatus main body 101. Between a mounting and dismounting direction Ya and Yb of the fixing device 30 with respect to the apparatus main body 101, the dismounting direction is Ya, and the mounting direction is Yb (see FIG. 2).

In the image forming device 11, process cartridges 11Y, 11M, 11C, and 11K including photosensitive drums are disposed along an intermediate transfer belt 11*a*. In the process cartridge 11Y, a yellow toner image is formed on the photosensitive drum and is primarily transferred to the intermediate transfer belt 11*a*. In the process cartridge 11M, a magenta toner image is formed on the photosensitive drum and is primarily transferred over the yellow toner image on the intermediate transfer belt 11*a*. In the process cartridges 11C and 11K, a cyan toner image and a black toner image, respectively, are formed on the relevant photosensitive drums, and are primarily transferred in a sequential manner onto the intermediate transfer belt 11*a* in a similar manner at positions that overlap the toner image on the intermediate transfer belt 11*a*.

Meanwhile, the recording material P that has been fed through the feeding unit 10 stands by before a transfer portion 12, and is sent to the transfer portion 12 at a timing matching the toner image on the intermediate transfer belt 11*a*.

The toner images of four colors carried on the intermediate transfer belt 11*a* are conveyed to the transfer portion 12, and is transferred all at once onto the recording material P that is, while overlapping the intermediate transfer belt 11*a*, pinched between and conveyed through the transfer portion 12. Subsequently, by passing the recording material P through the fixing device 30, the toner image is heat fixed to the recording material P, and when only one side is printed, the recording material P is discharged through a discharge roller 13. When the recording material is discharged through the discharge roller 13, the flapper 40 switches the conveyance path to a discharge roller 13 direction as illustrated by a broken line in FIG. 1 so that the recording material P passes under the flapper 40. In a case of double-side printing, after the front end of the recording material P has passed through the flapper 40 that has switched the conveyance path to a reversing roller 14 direction as illustrated in FIG. 1 and until the rear end of the recording material P reaches a reversing point B, a reversing roller 14 conveys the recording material P in a reverse path 141 direction. Subsequently, the orientation of the flapper 40 is switched to a duplex conveying roller 15 direction with a switching mechanism described later. In so doing, the reversing roller 14 reverses the rotation direction so that the recording material P is switched back so that the rear end is situated at the front, and so that the recording material P passes over the flapper 40 and is conveyed in the duplex conveying roller 15 direction. Subsequently, the recording material P passes through a both-surface conveyance path 16, and passes once more through the image forming device 11, the transfer portion 12, and the fixing device 30. The discharge roller 13 is provided downstream of the fixing device 30 in a conveyance direction of the recording material and is a discharging member that discharges the recording material. The reversing roller 14 is provided downstream of the fixing device 30 in the conveyance direction of the recording material and is a reversing member that conveys the recording material in a reversed manner by reversing the rotation direction.

Note that in the present exemplary embodiment, the position of the flapper 40 when the recording material P is conveyed in the duplex conveying roller 15 direction, and the position of the flapper 40 when the recording material is conveyed in the discharge roller 13 direction are the same as illustrated by the broken line in FIG. 1. Accordingly, at the above point, an operation of switching the position of the flapper 40 does not need to be performed. Accordingly, the recording material P that has passed through the fixing device 30 reaches the flapper 40 and is discharged in the discharge roller 13 direction.

Note that a right cover unit 60 including the transfer portion 12 and the both-surface conveyance path 16 is, with respect to the image forming apparatus main body 101, configured to be openable and closeable about a right cover rotation center 61. As illustrated in FIG. 2, by setting the right cover unit 60 in an open state with respect to the apparatus main body, the recording material remaining in the vicinity of the transfer portion when the sheet is jammed can be removed. Furthermore, the above allows the fixing device 30 to be dismounted from the image forming apparatus main body 101 in the dismounting direction Ya, which makes it easier to remove the recording material P pinched by the fixing device 30.

Incidentally, an operation guide to the user when the paper is jammed and various setting of the image forming apparatus, for example, are performed through an operation panel 80. For the sake of visibility of the operation panel 80 to the user and in order to efficiently use the space, the operation panel 80 is disposed on the right side of a discharging and reversing unit including the discharge roller 13 and the reversing roller 14, in other words, the operation panel 80 is disposed above the right cover unit 60. If the operation panel 80 rotates together with the right cover unit 60, the visibility will be compromised; accordingly, the operation panel 80 is disposed so as to be fixed to the image forming apparatus main body 101. Accordingly, the discharging and reversing unit including the discharge roller 13 and the reversing roller 14 is also disposed so as to be fixed to the image forming apparatus main body.

Schematic Configuration of Fixing Device

Figure 3:
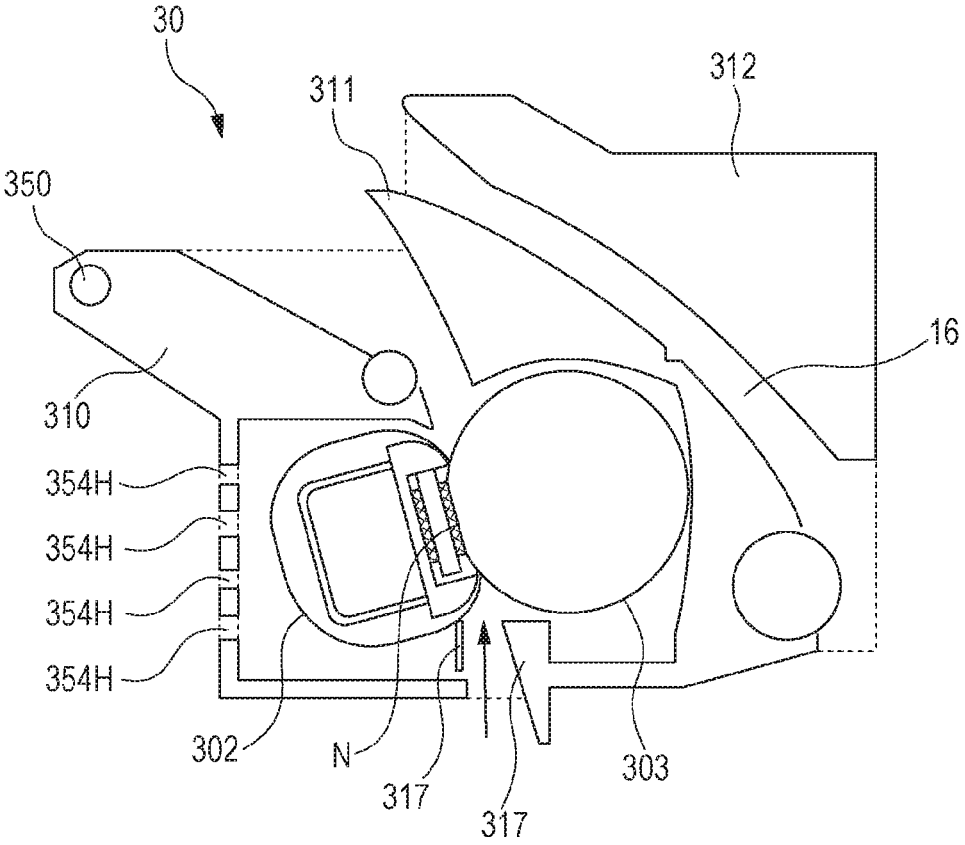
FIG. 3 is a schematic view of a fixing device.
Figure 4A:
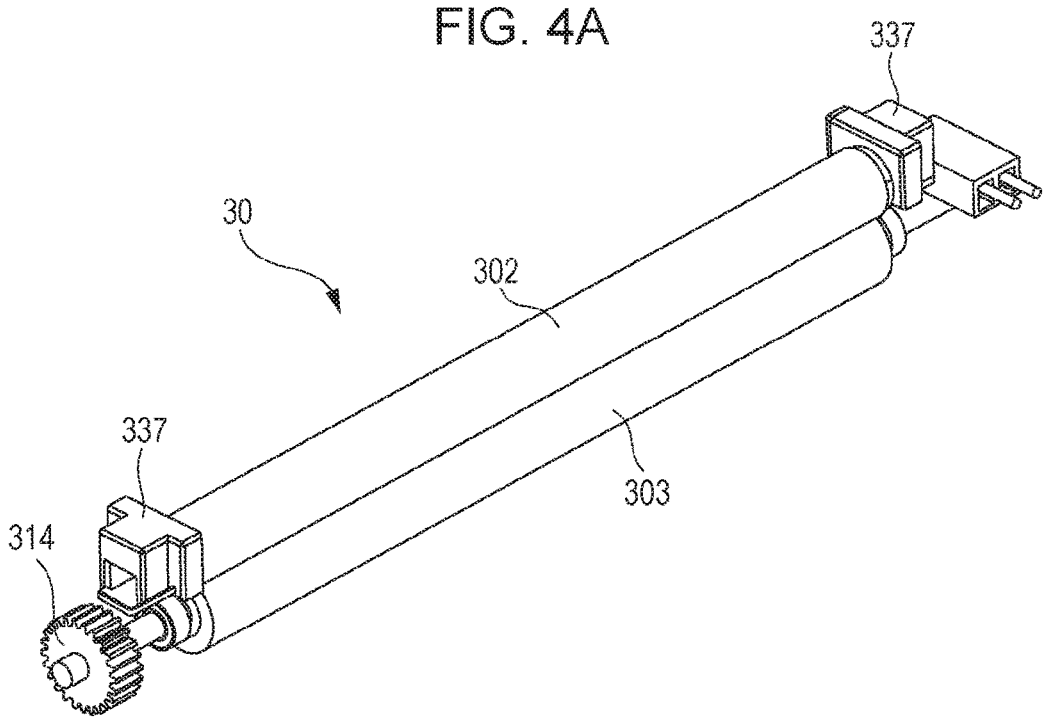
FIGS. 4A and 4B are perspective views of a pressure applying mechanism of the fixing device.
Figure 4B:
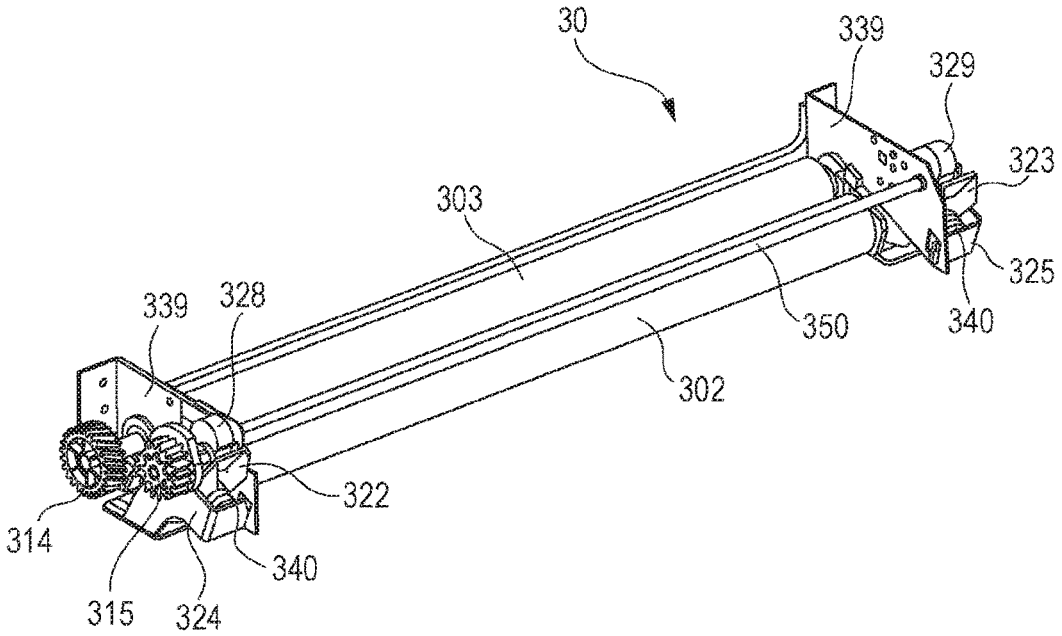
Figure 5:
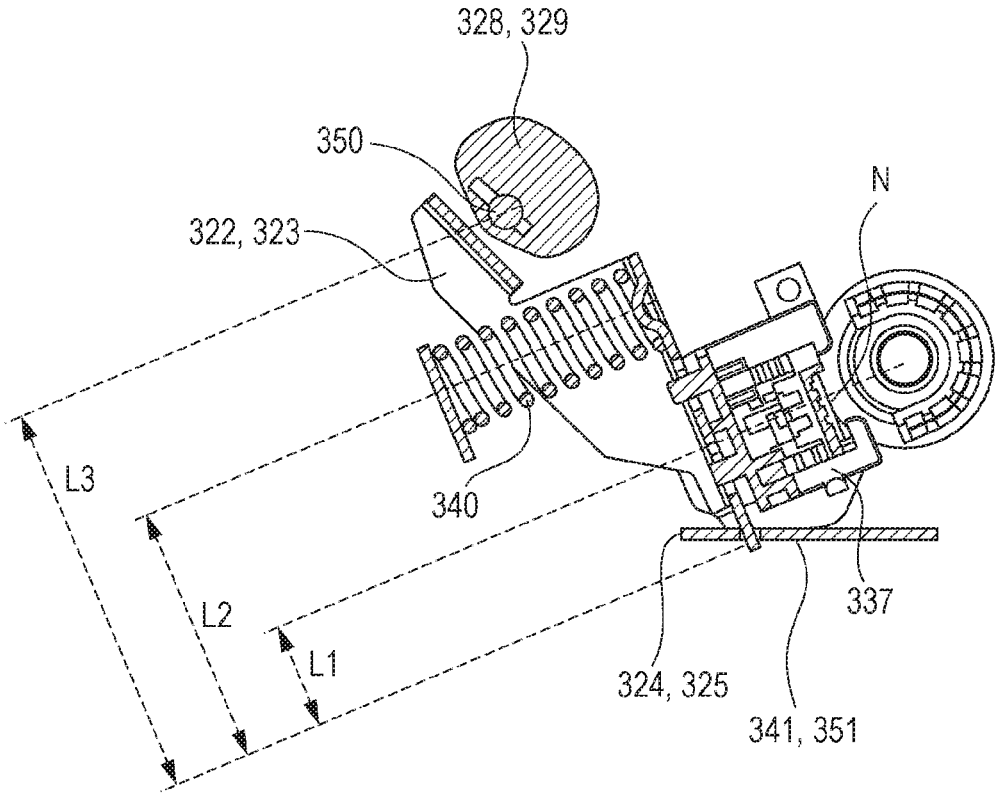
FIG. 5 is a cross-sectional view of the pressure applying mechanism of the fixing device.
Figure 6:
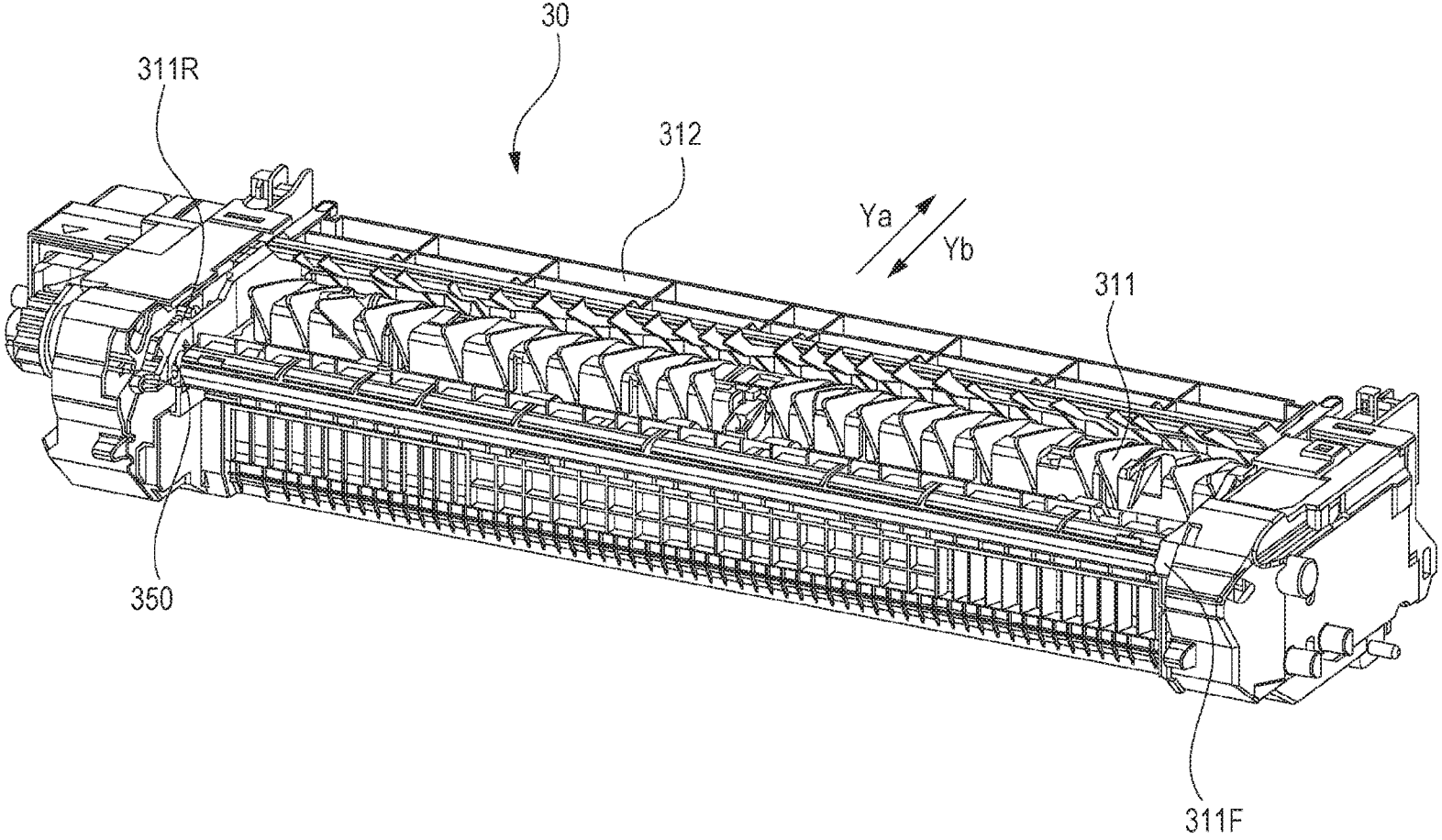
FIG. 6 is a perspective view of the fixing apparatus.

Referring next to FIGS. 3, 4A, 4B, and 5, the fixing device 30 that is a unit that is detachably attachable to the image forming apparatus main body will be described. FIG. 3 is a schematic view of the fixing device in the image forming apparatus. FIGS. 4A and 4B are perspective views of a pressure applying mechanism of the fixing device. FIG. 5 is a cross-sectional view of the pressure applying mechanism of the fixing device.

As illustrated in FIG. 3, the fixing device 30 includes a heating film assembly 302 serving as a heating rotation member, and a pressure contact roller 303 that is a pressing rotation member that comes in pressure contact with the heating film assembly 302. The fixing device 30 pinches and conveys the recording material P having a toner image while heating the recording material P, and fixes the toner image with the heating film assembly 302, the pressure contact roller 303. An entry guide 317 that guides the recording material to a nip portion N between the heating film assembly 302 and the pressure contact roller 303 is disposed upstream of the nip portion N in the conveyance direction of the recording material. A fixing device sheet discharge guide 310 and a fixing device reverse guide 311 are disposed downstream of the nip portion N in the conveyance direction of the recording material. The fixing device sheet discharge guide 310 is a first guide member that guides the recording material P from the nip portion N in the discharge roller 13 direction. The fixing device reverse guide 311 is second guide member that, while guiding the recording material P from the nip portion in the reversing roller 14 direction, guides the switched back recording material P in the duplex conveying roller 15 direction. The fixing device reverse guide 311 is provided upstream of the fixing device sheet discharge guide 310 in a direction (the arrow Yb direction in FIG. 2) in which the fixing device is mounted or inserted in the apparatus main body and is provided so as to oppose the fixing device sheet discharge guide 310. A fixing device upper reverse guide 312 is disposed opposite the fixing device reverse guide 311 with the both-surface conveyance path 16 in between.

Pressure Applying Configuration

As illustrated in FIGS. 4A and 4B, both end portions of the pressure contact roller 303 is rotatably supported by bearings (not shown) that are attached to fixing apparatus side plates 339 fixed inside the fixing device 30. The heating film assembly 302 serving as a heating member is supported by the fixing apparatus side plates 339 in a direction having the heating film assembly 302 to be in pressure contact with the pressure contact roller 303. A fixing device nip portion is formed by applying pressure to film regulating members 337 with pressure applying plates (a portion of the pressure applying mechanism) 322 and 323. First ends of the pressure applying plates 322 and 323 are engaged to holes 341 and 351 (FIG. 5) of support frames 324 and 325 attached to the fixing apparatus side plates 339. Pressure applying springs (a portion of the pressure applying mechanism) 340 that apply pressure to the film regulating members 337 while rotating the pressure applying plates 322 and 323 about rotation centers of the holes 341 and 351 are provided between the support frames 324 and 325 and the pressure applying plates 322 and 323.

Note that a large pressure generally needs to be applied to the nip portion to pinch and convey a recoding material P having a toner image thereon while heating the recording material P and, on the other hand, the pressure of the nip portion needs to be reduced during the jammed paper removing process when the user is removing the recoding material P pinched in the nip portion.

Accordingly, the fixing device 30 includes a pressure-changing mechanism that changes the pressure exerted on the fixing device nip portion. The pressure-changing mechanism includes cams 328 and 329 serving as cam members that act on the pressure applying mechanism. Pivoting of the cams 328 and 329 acts on the pressure applying plates 322 and 323 that are a portion of the pressure applying mechanism, and the pressure exerted on the fixing device nip portion N can be reduced.

The cams 328 and 329 serving as cam members that act on the pressure applying mechanism are fixed to both sides of a cam rotating shaft 350. The cam rotating shaft 350 includes, on one side thereof, a gear 315 that transmits the drive to the rotating shaft.

Furthermore, the fixing device 30 includes a gear 314 that drives the pressure contact roller 303. The fixing device 30 is configured so that drive force from a motor (not shown) serving as a drive source provided in the image forming apparatus main body 101 is transmitted to the gears 315 and 341.

As described above, a large pressure needs to be applied to the nip portion to pinch and convey the recording material P having a toner image thereon while the recording material P is heated. As illustrated in FIG. 5, in order to efficiently exert pressure, a distance L2 between each pressure applying spring 340 and the rotation center of the corresponding one of the pressure applying plate 322 and 323 needs to be larger than a distance L1 between the nip portion N and the rotation centers of the pressure applying plates 322 and 323 (L2>L1). Furthermore, in order to efficiently reduce the pressure of the nip portion N during the jammed paper removing process, distances L3 between the rotation centers of the pressure applying plates 322 and 323 and the contact positions of the cams 328 and 329 need to be longer (L3>L2).

In other words, the nip portion N and the cam rotating shaft 350 of the cams 328 and 329 need to be disposed so as to be distanced away from each other.

(Cooling End Portions of Heating Film Assembly)

When recording materials P having a width that is small with respect to the length of the heating film assembly 302 in the longitudinal direction are continuously passed through, heat of the area in the heating film assembly 302 where the recording materials P pass is taken away by the continuously passing recording material P. However, heat is accumulated in the areas in the heating film assembly 302 where the recording materials P do not pass; accordingly, the above areas need to be cooled. Accordingly, as illustrated in FIG. 3, front cover louvers 354H that are air openings that cool the areas where the recording materials P do not pass in the heating film assembly 302 are provided in a front cover 354.

Note that since the cam rotating shaft 350 needs to be disposed at a position that does not get in the way of the air passage that cools the areas described above in the heating film assembly 302 where the recording materials P do not pass, the cam rotating shaft 350 consequently needs to be disposed at the upper left portion in FIG. 3, in other words, in the vicinity of the discharge roller 13.

The fixing device sheet discharge guide 310 described above is disposed so as to cover the cam rotating shaft 350 so that the recording material P proceeding in the discharge roller 13 direction does not become caught.

(Flapper Abutment Portion)

Figure 7:
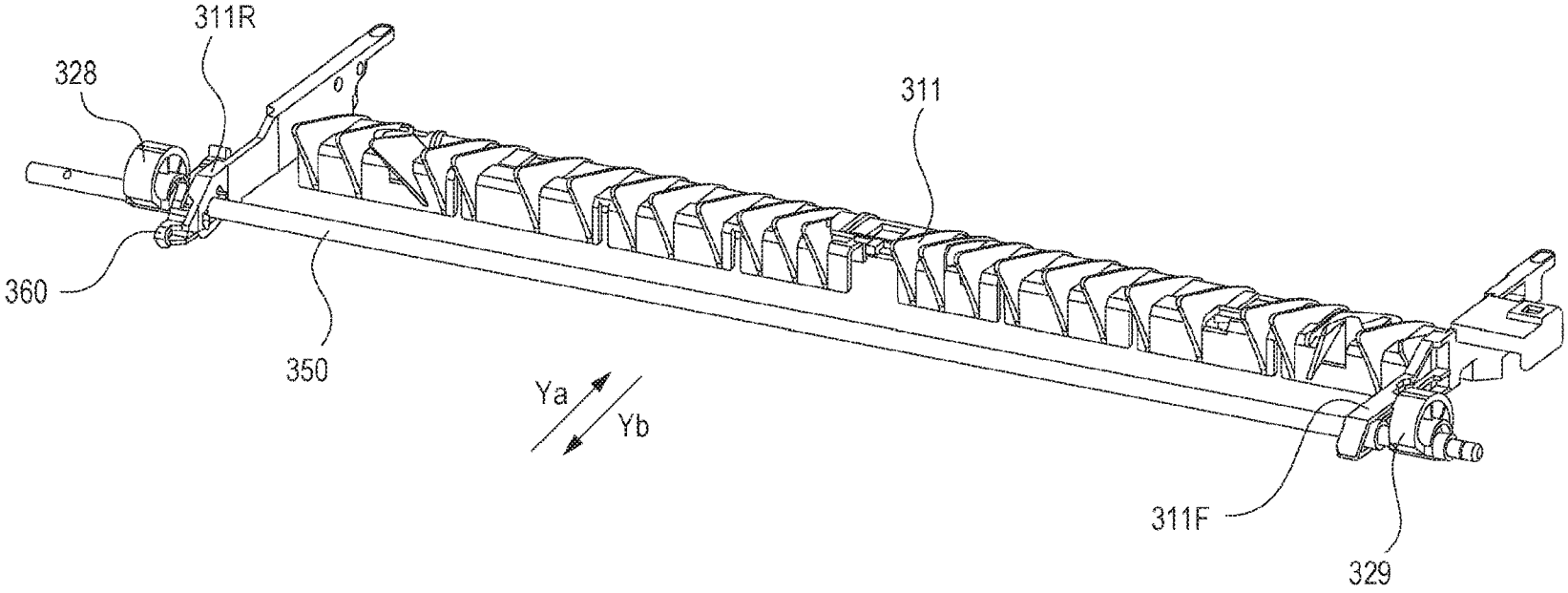
FIG. 7 is a diagram of flapper abutment components equipped in the fixing device.

A component illustrated in FIG. 7 that is equipped in the fixing device 30 and that abuts against the flapper 40 will be described.

A flapper pushing-up portion 311R and an insertion link pushing-up portion 311F that extend towards the cam rotating shaft 350 are provided at two ends of the fixing device reverse guide 311 in the longitudinal direction. The flapper pushing-up portion 311R is provided on a first side (apparatus rear side) in the longitudinal direction, and is disposed so as to push up an abutment portion 402 of the flapper 40 described later and to direct the recording material P conveyed from the fixing device nip portion towards the conveyance path extending in the discharge roller 13 direction. The insertion link pushing-up portion 311F is provided on a second side (apparatus front side) in the longitudinal direction, and is disposed so as to push up a unit insertion link 90 described later.

Furthermore, a flapper link 360, which is rotatably provided so as to be rotated by a drive source described later, is provided on the cam rotating shaft 350 and outside the flapper pushing-up portion 311R so that the flapper 40 directs the conveyance path in the reversing roller 14 direction.

Attaching and Detaching Mechanism of Fixing Device

Figure 8:
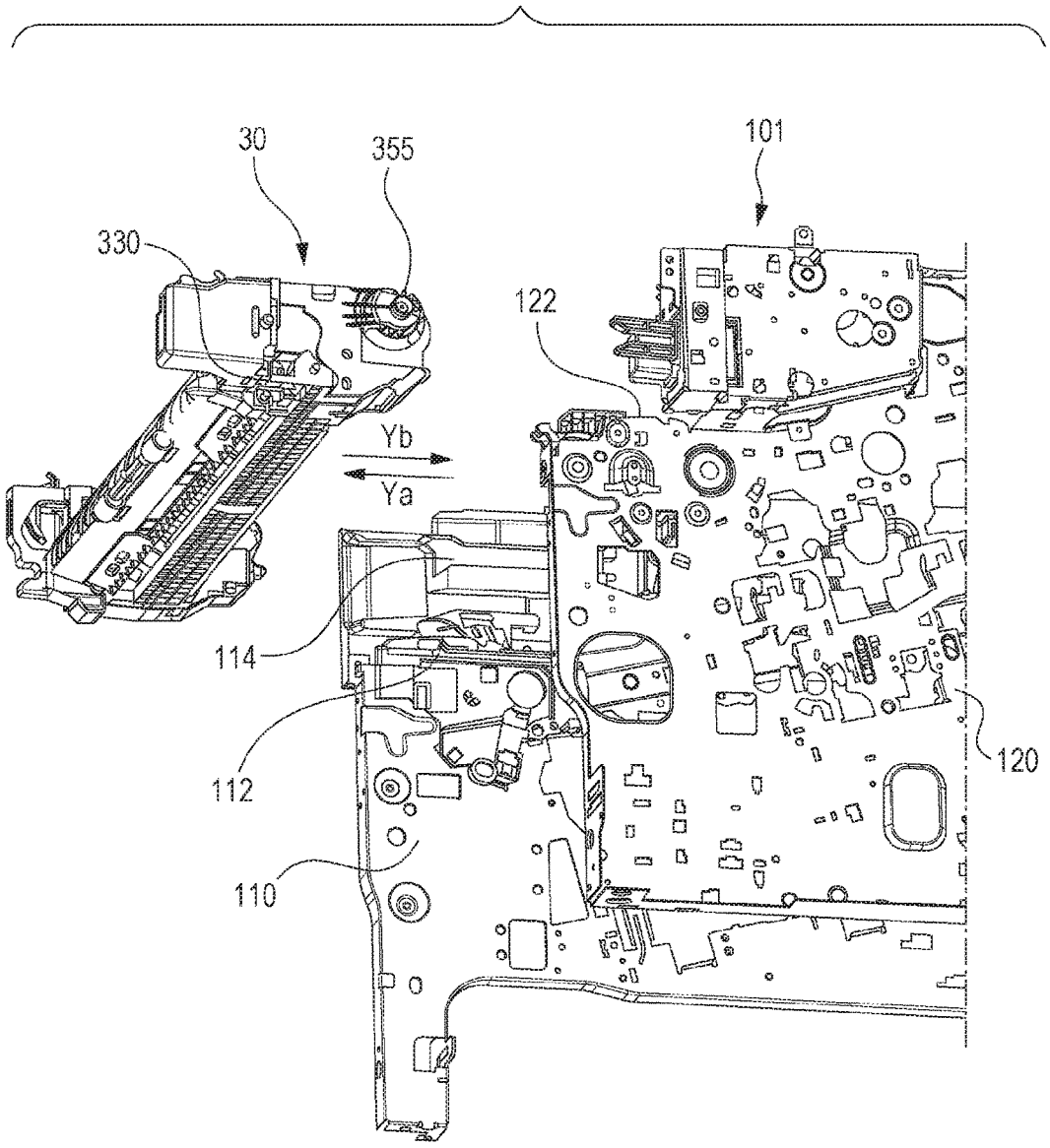
FIG. 8 is a schematic block diagram of a mounting and dismounting mechanism of the fixing device.

Referring next to FIG. 8, a schematic configuration of a mechanism that attaches and detaches the fixing device 30 to and from the image forming apparatus main body 101 will be described.

Main frame horizontal guide portions 112 and 122 serving as a pair of attachment and detachment guides that support positioning pins 330 of the fixing device 30 are disposed in the image forming apparatus main body 101. The main frame horizontal guide portions 112 and 122 are provided in the main frames 110 and 120 in a horizontal manner. Similar to the main frame horizontal guide portions 112 and 122, fixing device rails 114 that guide guiding portions 355 of the fixing device 30 are provided in the main frames 110 and 120 in a horizontal manner. The fixing device 30 is movable in the mounting and dismounting direction Ya and Yb while maintaining a set position by having the positioning pins 330 be guided by the main frame horizontal guide portions 112 and 122 and, in a similar manner, by having the guiding portions 355 be guided by the fixing device rails 114.

(Configuration of Discharging and Reversing Unit)

Figure 9:
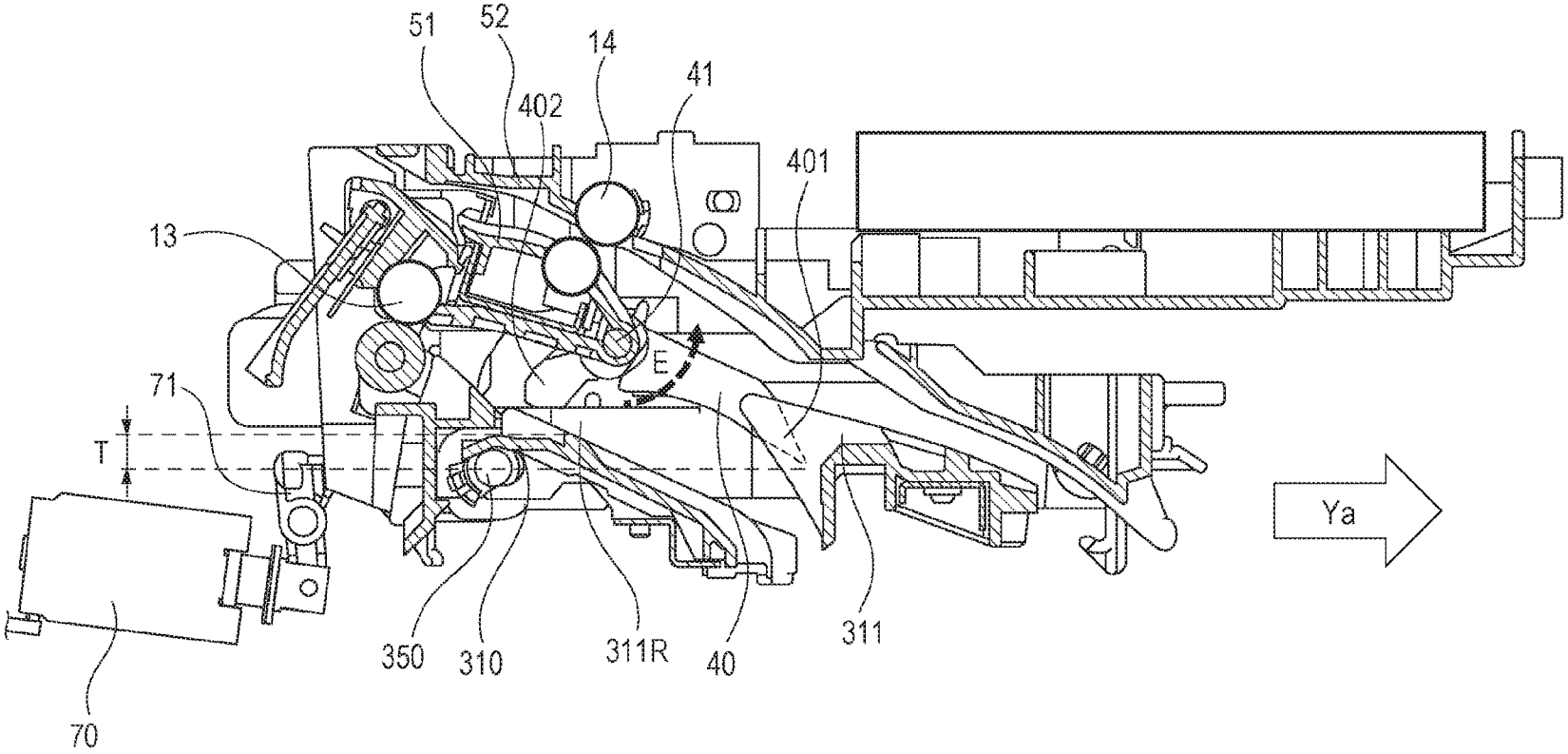
FIG. 9 is a diagram of components of a discharging and reversing unit of the image forming apparatus.
Figure 14A:
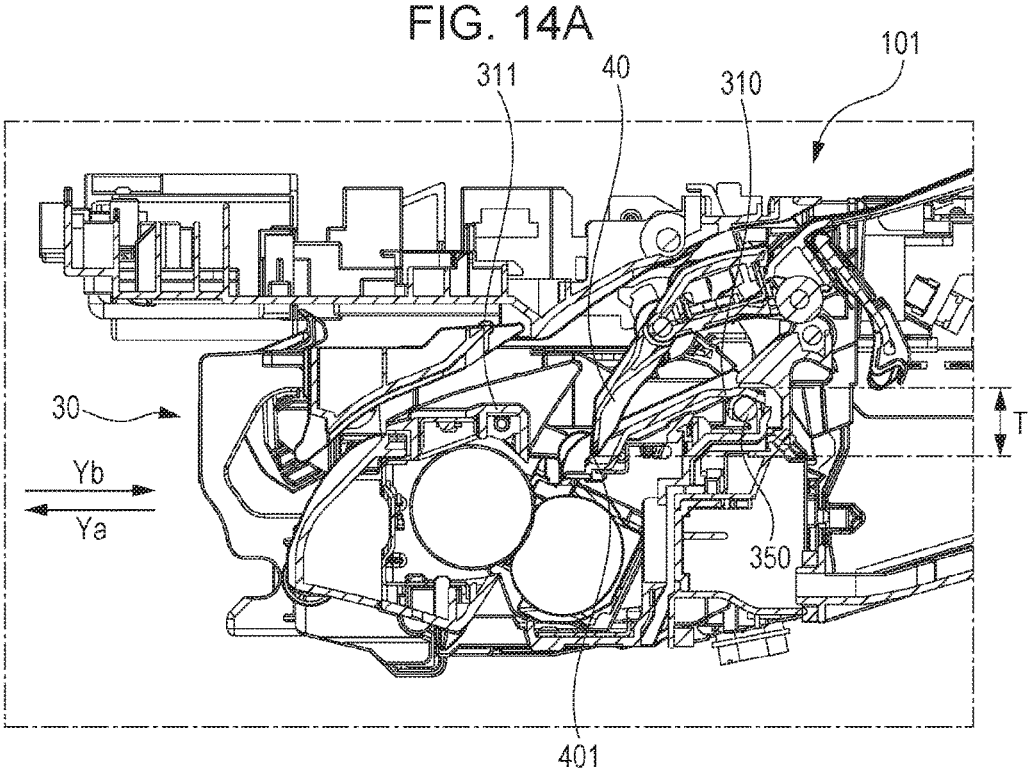
FIGS. 14A and 14B are diagrams illustrating the manner in which the fixing device is mounted to or dismounted from the apparatus main body.

Illustrated next in FIG. 9 is an arrangement of the discharging and reversing unit disposed so as to be fixed to the image forming apparatus main body 101, and the fixing device sheet discharge guide 310, the fixing device reverse guide 311, and the fixing device upper reverse guide 312 of the fixing device 30 disposed so as to be mountable and dismountable to and from the image forming apparatus main body 101. FIG. 9 illustrates a state viewed from the apparatus front side in which the fixing device 30 is mounted in the image forming apparatus main body 101 and a state in which the flapper 40 is switched to the position illustrated by a broken line in FIG. 1. The position of the flapper 40 illustrated in FIG. 9 is a position in which the recording material that has passed through the fixing device is guided in the discharge roller direction, and a position in which the recording material conveyed after being reversed by the reversing roller is guided in a duplex conveying roller direction. FIG. 14A illustrates a state viewed from the apparatus rear side in which the fixing device 30 is mounted in the image forming apparatus main body 101 and a state in which the flapper 40 is switched to the position illustrated by a solid line in FIG. 1. The position of the flapper 40 illustrated in FIG. 14A is a position in which the recording material that has passed through the fixing device is guided in a reversing roller direction. Note that FIG. 14A illustrates the overall fixing device 30 mounted in the apparatus main body 101.

The flapper 40 serving as the switching member is disposed on a discharging and reversing guide 51 with a flapper pivot shaft 41 in between and can be pivoted at a set angle. The discharging and reversing guide 51 is disposed so at to be fixed to a discharging and reversing frame 52. The flapper 40 is biased about the flapper pivot shaft 41 in an arrow E direction illustrated in FIG. 9 at all times with biasing force of a biasing spring (a biasing member). When the fixing device is mounted in the image forming apparatus main body, the flapper 40 is pivoted to a direction opposite to the arrow E direction illustrated in FIG. 9 by having the flapper abutment portion 402 provided on the apparatus rear side of the flapper 40 abut against the flapper pushing-up portion 311R of the fixing device reverse guide 311. Accordingly, in a state illustrated in FIG. 9 in which the fixing device is mounted in the image forming apparatus main body, the flapper 40 is set at a position in which the conveyance path is set in the discharge roller 13 direction. In the above state, the flapper 40 is at a position illustrated in FIG. 9, and is at a first guiding position illustrated by the broken line in FIG. 1. Accordingly, the recording material that has passed between the nip portion of the fixing device passes through a first conveyance path between one side of the flapper 40 at the first guiding position and the fixing device sheet discharge guide 310, and is guided in the discharge roller 13 direction that is a first direction.

A front end portion 401 of the flapper 40 at the first guiding position enters the fixing device, from a mounting and dismounting locus 310T of the uppermost point of the fixing device sheet discharge guide 310 in the fixing device, in a direction intersecting the mounting and dismounting direction Ya and Yb by an overlapping amount T. The overlapping amount T illustrated in FIG. 9 is the amount in which the front end portion 401 of the flapper 40 at the first guiding position has entered the fixing device, from the mounting and dismounting locus 310T of the fixing device, in the direction intersecting the mounting and dismounting direction Ya and Yb.

Furthermore, in the above, the front end portion 401 of the flapper 40 is set to overlap the fixing device reverse guide 311, as illustrated in FIG. 9, so that the front end of the recording material P exiting the nip portion of the fixing device 30 does not become caught. Note that when the fixing device is mounted into the image forming apparatus main body, the uppermost point of the fixing device sheet discharge guide 310 of the fixing device passes below the front end portion 401 of the flapper 40 that has been retracted to a retracted position described later. Subsequently, as described above, the flapper pushing-up portion 311R of the fixing device abuts against the flapper abutment portion 402. With the above, the flapper 40 at the retracted position is pivoted, and the front end portion 401 of the flapper 40 enters the fixing device by the overlapping amount T from the mounting and dismounting locus 310T of the uppermost point of the fixing device sheet discharge guide 310. Furthermore, when the mounting of the fixing device is completed, the front end portion 401 of the flapper 40 overlaps the fixing device reverse guide 311 as illustrated in FIG. 9. Furthermore, the fixing device sheet discharge guide 310 of the fixing device 30 is, as described above, disposed so as to cover the cam rotating shaft 350.

On the other hand, in a state illustrated in FIG. 14A in which the fixing device is mounted in the image forming apparatus main body, the flapper 40 is switched to the reversing roller 14 direction with a solenoid 70 described later. In such a state, the flapper 40 is switched to a second guiding position illustrated by the solid line in FIG. 1. Accordingly, the recording material that has passed between the nip portion of the fixing device passes through a second conveyance path between the other side of the flapper 40 at the second guiding position and the fixing device reverse guide 311, and is guided in the reversing roller 14 direction that is a second direction different from the first direction.

Furthermore, the flapper 40 that has been switched to the second guiding position illustrated in FIG. 14A is, compared with the first guiding position illustrated in FIG. 9, pivoted further in a direction opposite the arrow E direction illustrated in FIG. 9. Accordingly, compared with the first guiding position, the front end portion 401 of the flapper 40 enters more into the fixing device. In other words, the front end portion 401 of the flapper 40 at the second guiding position enters the fixing device, from the mounting and dismounting locus 310T of the uppermost point of the fixing device sheet discharge guide 310 in the fixing device, in a direction intersecting the mounting and dismounting direction Ya and Yb by an overlapping amount Tmax. The overlapping amount Tmax illustrated in FIG. 14A is the amount in which the front end portion 401 of the flapper 40 that has moved to a position illustrated by a solid line in FIG. 1 has entered the fixing device, from the mounting and dismounting locus 310T of the fixing device, in the direction intersecting the mounting and dismounting direction Ya and Yb. The relationship between the inroad amount of the flapper 40, into the fixing device, at the first guiding position illustrated in FIG. 9 and the inroad amount of the flapper 40, into the fixing device, at the second guiding position illustrated in FIG. 14A satisfies T<Tmax. In other words, compared with the first guiding position illustrated in FIG. 9, in the second guiding position illustrated in FIG. 14A, the flapper 40 enters more into the fixing device from the mounting and dismounting locus 310T of the fixing device, and the overlapping amount Tmax is the largest inroad amount of the flapper 40.

Figure 10:
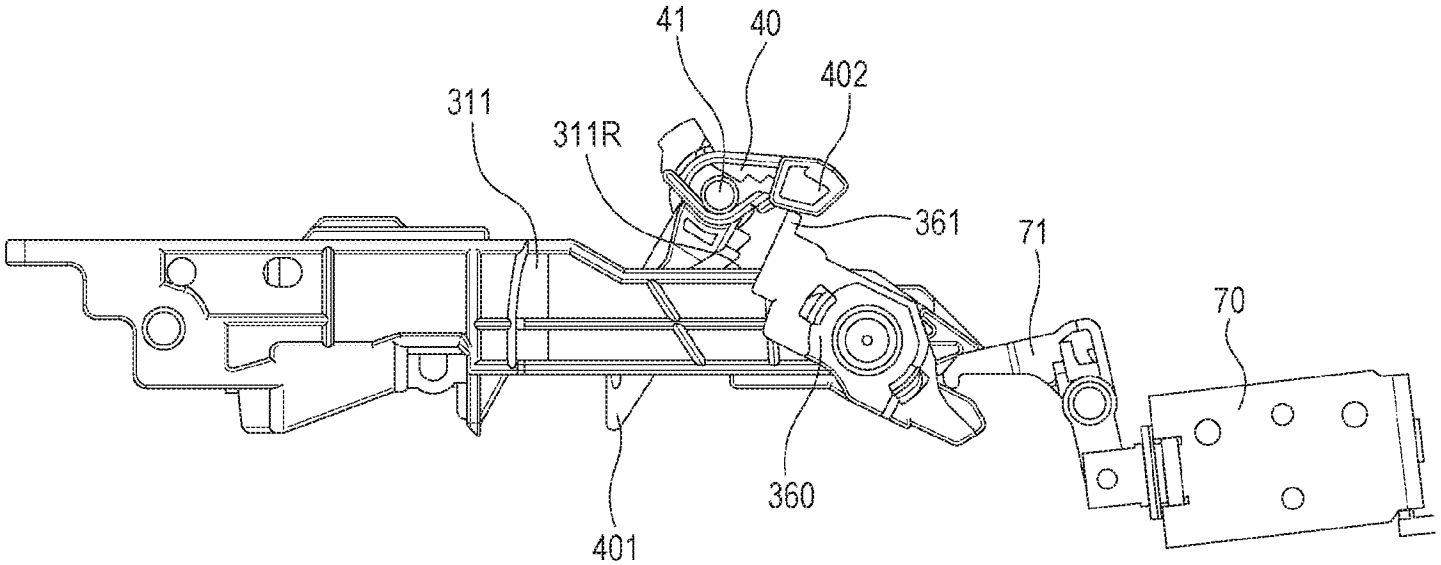
FIG. 10 is a diagram of components of a flapper pivoting link mechanism of the image forming apparatus.

FIG. 10 illustrates a link mechanism that pivots the flapper, viewed from the back side of the image forming apparatus main body 101. The link mechanism described hereinafter is a switching mechanism that selectively switches the flapper 40, which is in a state in which the front end portion 401 thereof has entered the fixing device 30 that has been mounted in the apparatus main body 101, to a route (the conveyance path) that the recording material is guided towards. The link mechanism includes the solenoid 70 described later, a solenoid link 71, and the flapper link 360.

When the solenoid 70 disposed so as to be fixed to the image forming apparatus main body 101 is actuated to perform suction by having an electrical signal sent thereto, the solenoid link 71 pivots and pushes one end of the flapper link 360 down, and a flapper link front end portion 361 on the other end pushes the flapper abutment portion 402 up. With the above, the flapper 40 is set at a position in which the conveyance path is set in the reversing roller 14 direction.

By stopping sending the electric signal to the solenoid 70, the suctioning is stopped, and the sheet conveyance path of the flapper 40 is returned to the discharge roller 13 direction with the biasing force of the biasing spring (not shown) described above.

(Dismounting Fixing Device)

Figure 11:
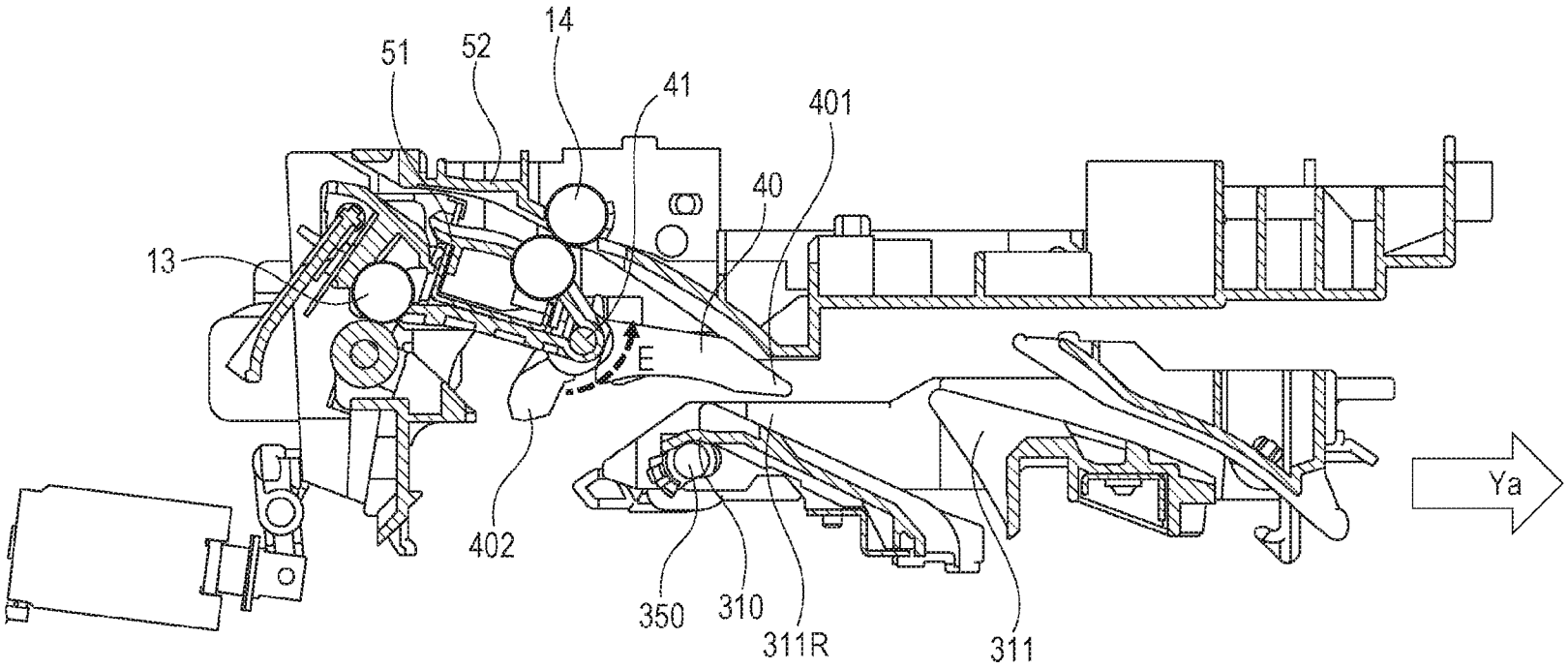
FIG. 11 is a diagram of components of the discharging and reversing unit in the course of pulling out the fixing device.
Figure 14B:
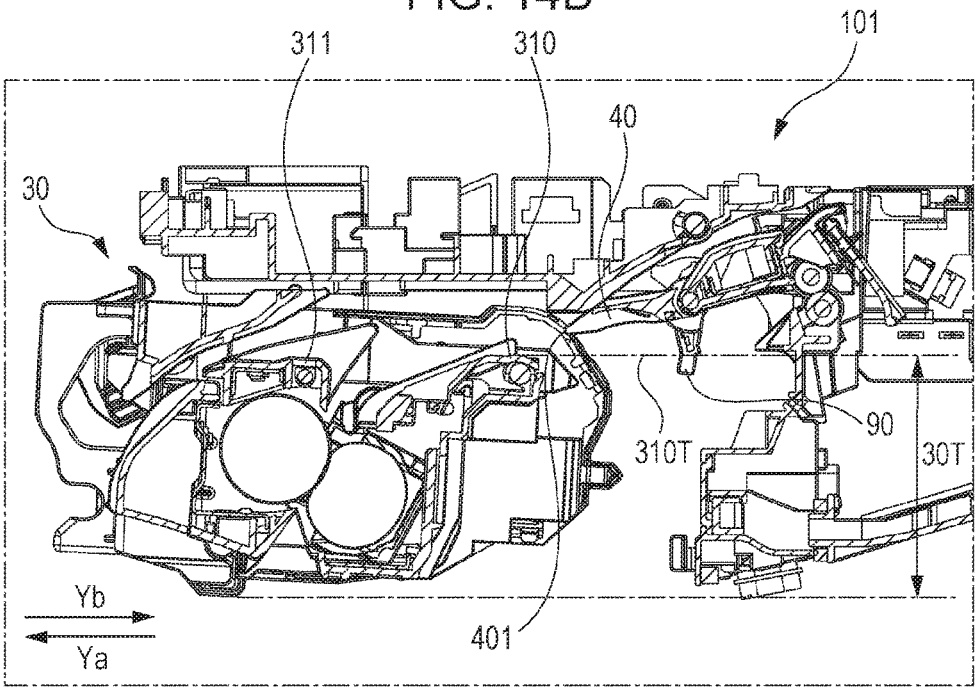

FIGS. 11 and 14B illustrates a process of dismounting the fixing device 30 from the image forming apparatus main body 101. Note that FIG. 11 illustrates the fixing device sheet discharge guide 310, the fixing device reverse guide 311, and the fixing device upper reverse guide 312 of the fixing device 30. FIG. 14B illustrates an overall fixing device 30 in the course of dismounting the fixing device 30 from the apparatus main body 101.

As illustrated in FIGS. 11 and 14B, in the course of dismounting the fixing device 30 from the image forming apparatus main body 101, the abutment portion 402 of the flapper 40 is released from the flapper pushing-up portion 311R of the fixing device reverse guide 311. Accordingly, the flapper 40 can rotate to an angle at which the flapper front end portion 401 does not overlap the fixing device sheet discharge guide 310 in the direction intersecting the mounting and dismounting direction Ya and Yb.

Typically, drive sources such as the solenoid 70 and the motor are disposed in an area around the electric substrate to shorten the bundle wire thereof as short as possible. In other words, in the present exemplary embodiment, since the electric substrate is disposed on the rear side of the image forming apparatus, the solenoid 70 is also disposed on the apparatus rear side. Accordingly, the solenoid 70 is required to be as small as possible in the area on the apparatus rear side having a relatively small space. Furthermore, generally, since the suction force of the solenoid changes according to the winding number of the coil built in the solenoid, the required suction force needs to be set small to reduce the size of the solenoid.

In the present exemplary embodiment, in order to keep the size of the solenoid 70 described above small and efficiently decrease the size of the main body, flapper biasing force (force in the arrow E direction) by the biasing spring applied to the flapper 40 is set small to restrict the suction force needed when suctioning. Accordingly, the biasing spring is not set to have biasing force that biases the flapper front end portion 401 to an angle, in other words, to and angle closed to horizontal, that overlaps the flapper front end portion 401 over the fixing device sheet discharge guide 310 in the direction intersecting the mounting and dismounting direction Ya and Yb.

The unit insertion link 90 serving as a retracting member is provided on the apparatus front side of the apparatus main body 101. The unit insertion link 90 is provided so that the unit insertion link 90 can be abutted or separated from the flapper 40. The unit insertion link 90 is biased in a direction (an arrow F direction in FIG. 12A) that retracts the flapper 40 to the outside of the mount area of the fixing device. When the fixing device 30 is pulled out from the apparatus main body 101, the unit insertion link 90 reliably lifts up the flapper 40 to an angle at which the flapper front end portion 401 of the flapper 40 does not overlap the fixing device sheet discharge guide 310 in the direction intersecting the mounting and dismounting direction Ya and Yb. In other words, the unit insertion link 90 is a retracting member that, in the course of dismounting the fixing device from the apparatus main body, retracts the flapper 40 to the outside of the mount area of the fixing device in the apparatus main body. The unit insertion link 90 is provided outside the recording material conveying area in a width direction orthogonal to the conveyance direction of the recording material. Note that the mount area of the fixing device is, as illustrated in FIG. 14B, an area 30T between the mounting and dismounting locus 310T of the uppermost point of the fixing device sheet discharge guide 310 in the mounting and dismounting direction Ya and Yb and a lower end portion of the fixing device. The outside of the mount area to which the flapper 40 is retracted is the outside of a mount area 30T. In further detail, the outside of the mount area to which the flapper 40 is retracted is, as illustrated in FIG. 14B, the outside (the upper side) of the mounting and dismounting locus 310T of the uppermost point of the fixing device sheet discharge guide 310 in the mounting and dismounting direction Ya and Yb. The flapper front end portion 401 of the flapper 40 is retracted to a position that does not overlap the fixing device sheet discharge guide 310 in the direction that intersects the mounting and dismounting direction Ya and Yb.

Figure 12A:
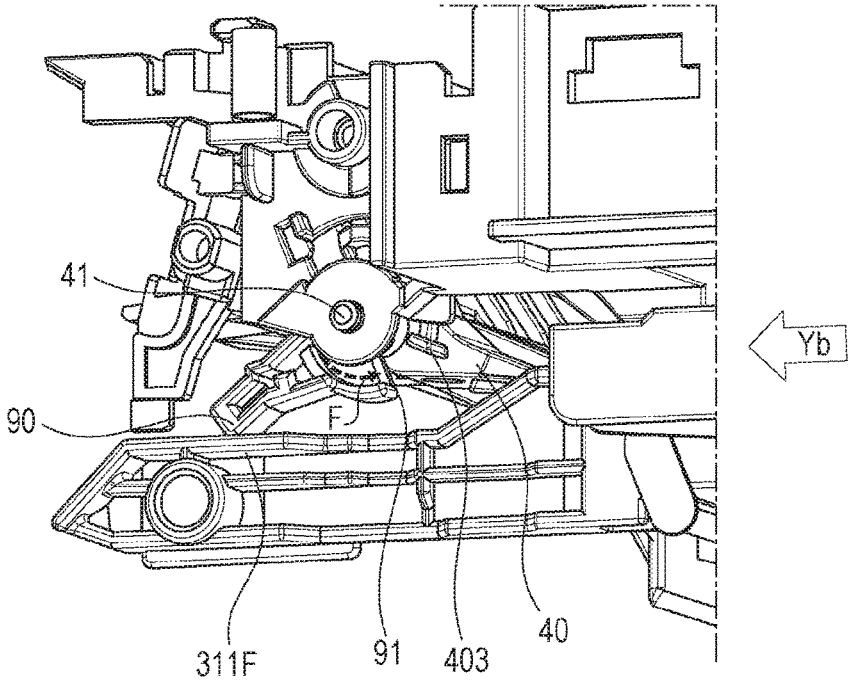
FIG. 12A is a perspective view around the insertion link in a state in which the fixing device is mounted.
Figure 12B:
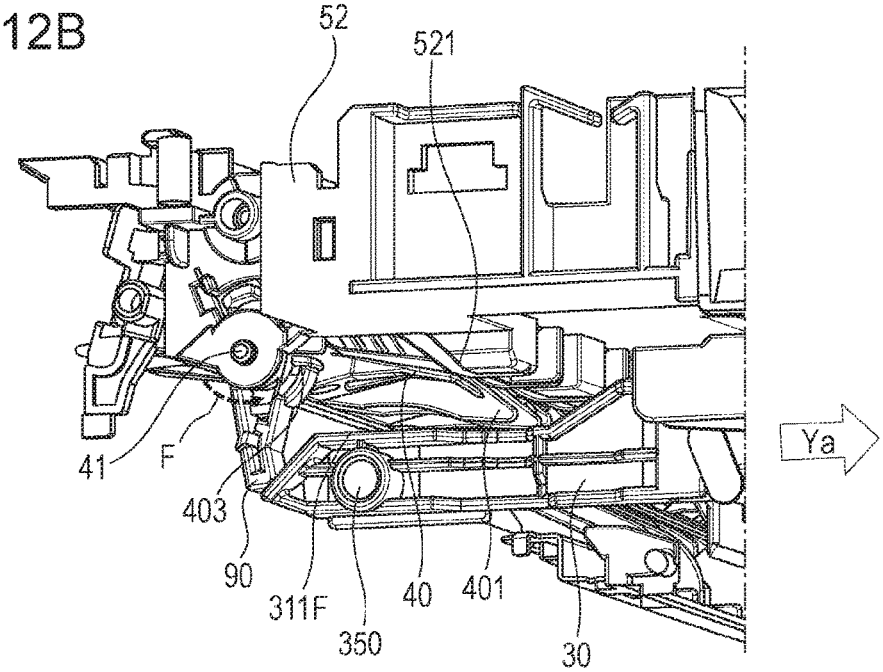
FIG. 12B is a perspective view around the insertion link in the course of pulling out the fixing device.
Figure 15A:
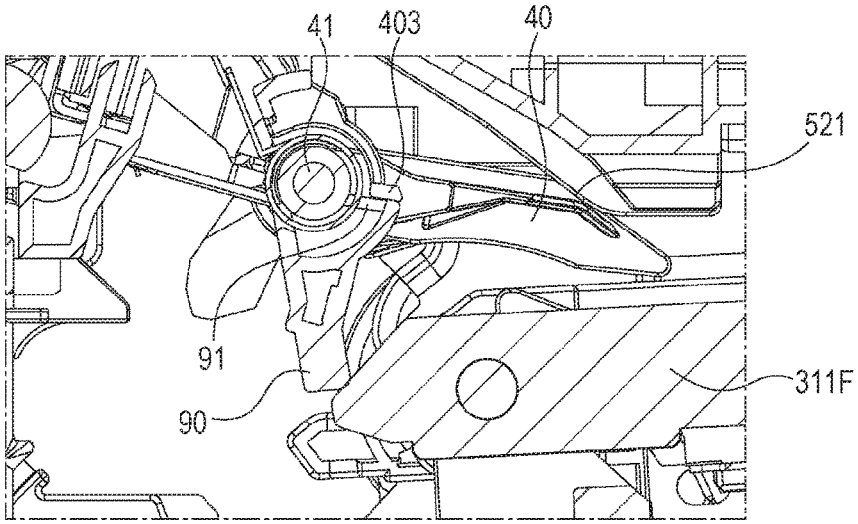
FIGS. 15A to 15C are diagrams illustrating movements of the flapper viewed from the apparatus front side.
Figure 15B:
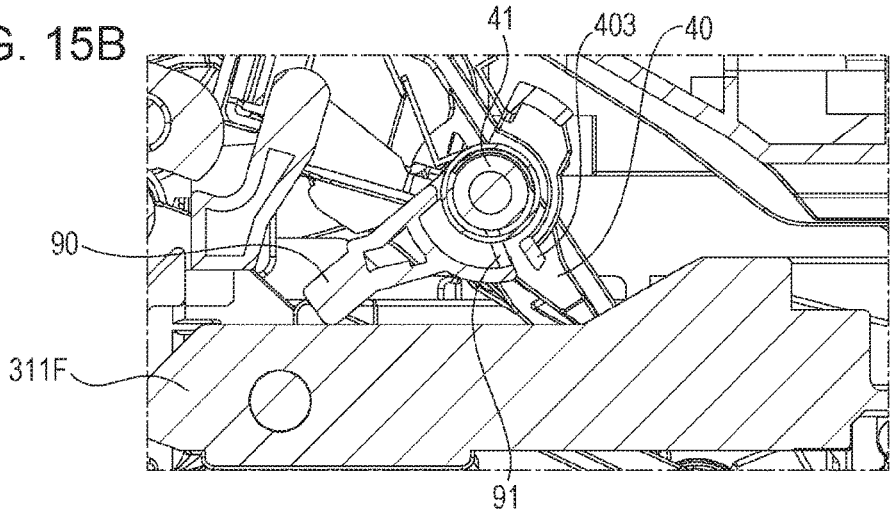
Figure 15C:
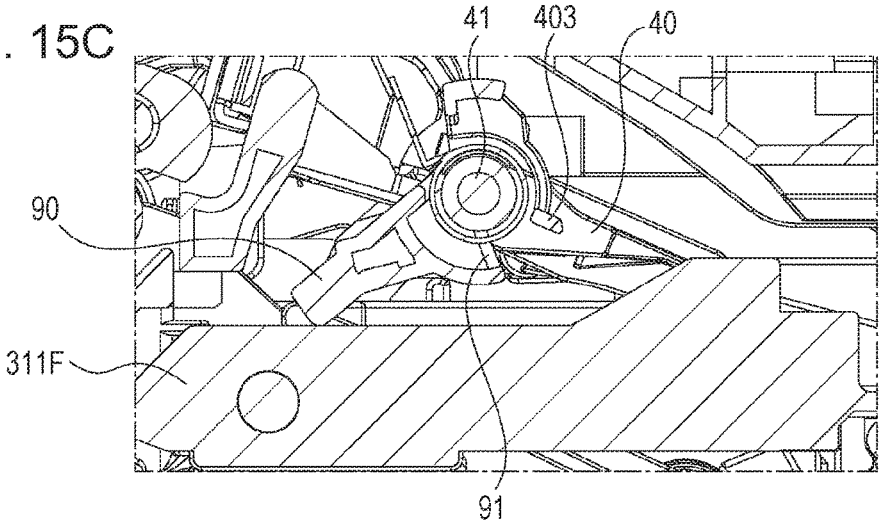
Figure 16A:
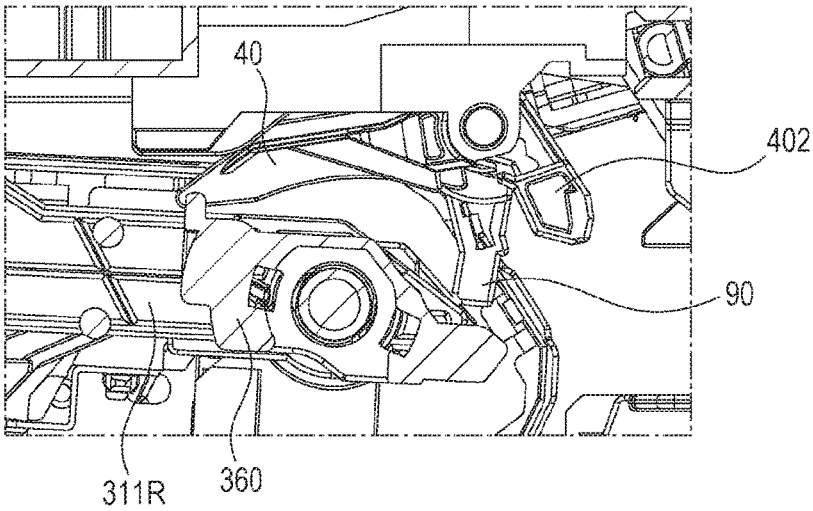
FIGS. 16A to 16C are diagrams illustrating movements of the flapper viewed from the apparatus rear side.
Figure 16B:
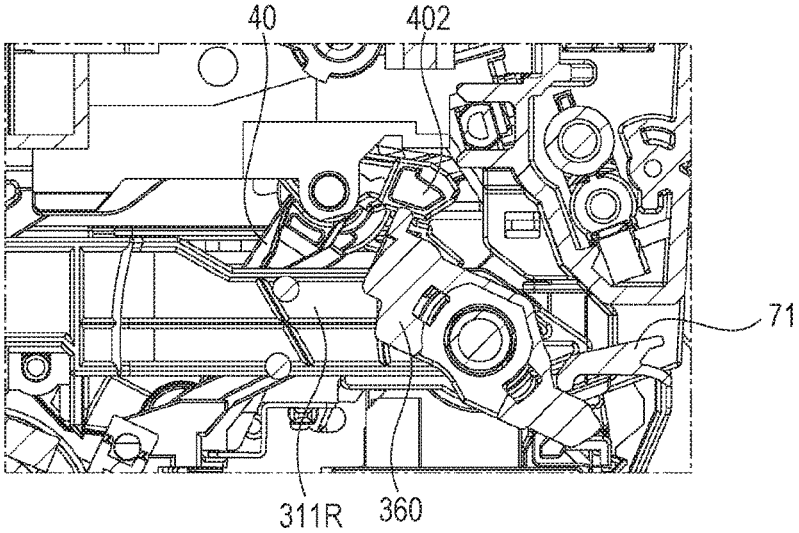
Figure 16C:
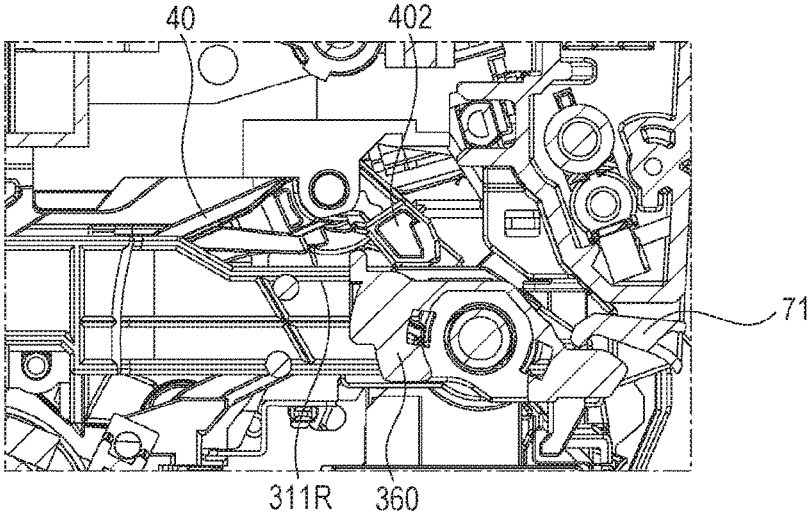
Figure 17:
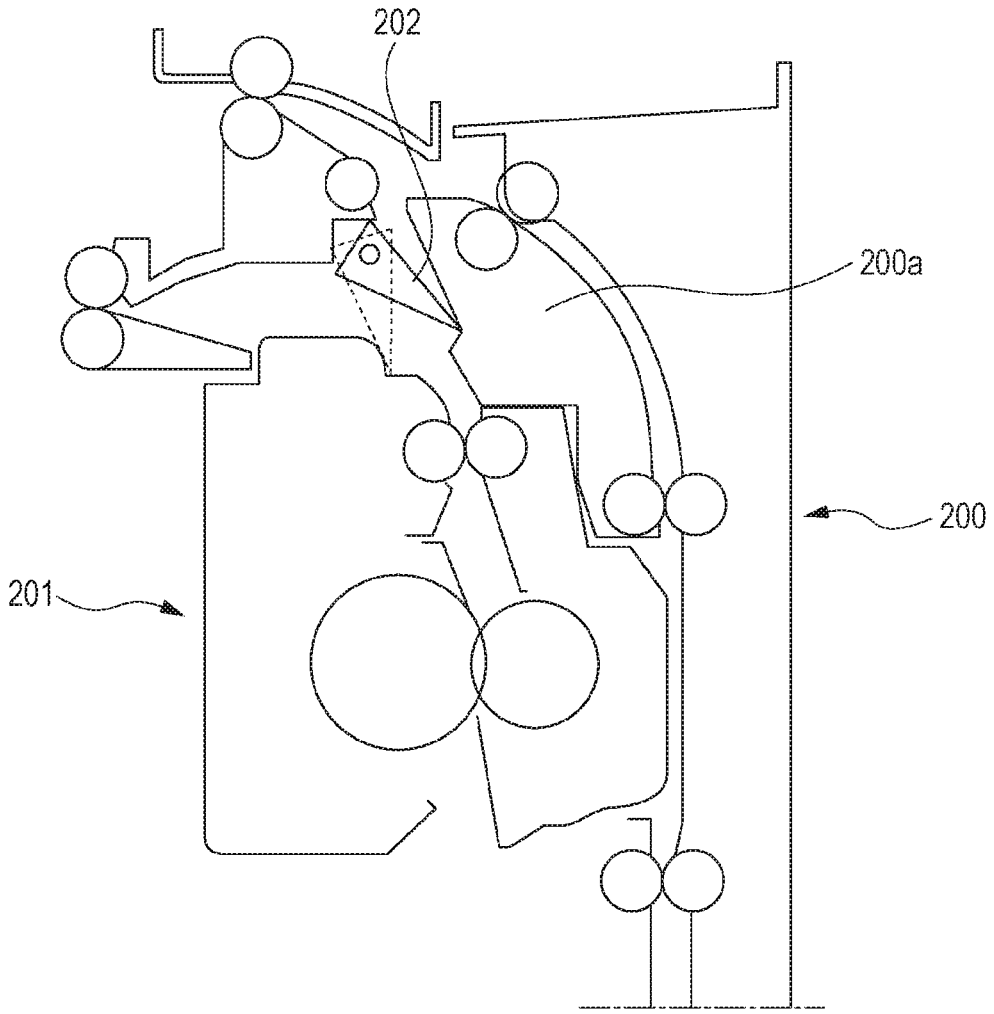
FIG. 17 is an explanatory drawing of a conventional technique.
Figure 18:
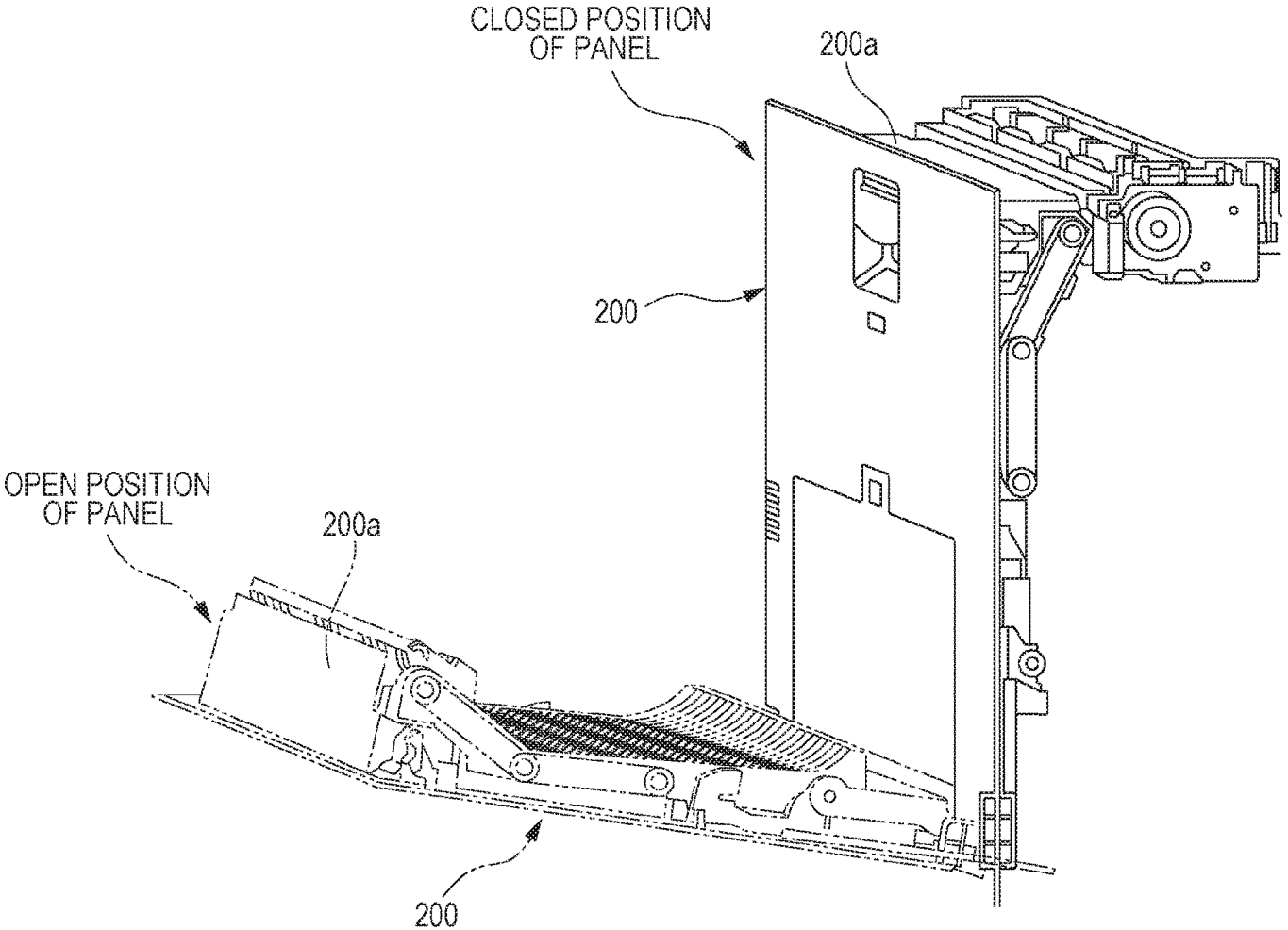
FIG. 18 is an explanatory drawing of a conventional technique.

FIG. 12A illustrates a perspective view around the unit insertion link 90 when the fixing device 30 is mounted in the image forming apparatus main body 101. FIG. 12B illustrates a perspective view around the unit insertion link 90 disposed on the front side of the fixing device reverse guide 311, at a position of the fixing device 30 in FIG. 11 in which the fixing device is being pulled out from the image forming apparatus main body. Furthermore, FIGS. 15A and 16A illustrate the unit insertion link while the fixing device is pulled out from the image forming apparatus main body. FIGS. 15B and 15C, and FIGS. 16B and 16C illustrate the unit insertion link in which the fixing device has been mounted in the image forming apparatus main body. Furthermore, FIGS. 15A to 15C illustrates the apparatus front side, and FIGS. 16A to 16C illustrates the apparatus rear side. Note that the apparatus rear side is one side of the fixing device reverse guide 311 illustrated in FIG. 7 in the longitudinal direction on which the flapper pushing-up portion 311R is provided. The apparatus front side is the other side of the fixing device reverse guide 311 illustrated in FIG. 7 in the longitudinal direction on which the insertion link pushing-up portion 311F is provided.

As illustrated in FIGS. 12A and 12B, the unit insertion link 90 is disposed so as to be pivotable in a predetermined angle range about the flapper pivot shaft 41. Biasing force in the arrow F direction is acting on the unit insertion link 90 at all times. The unit insertion link 90 is provided so that the unit insertion link 90 can be abutted or separated from the flapper 40. Specifically, by pivoting the unit insertion link 90, an insertion link abutment portion 91 of the unit insertion link 90 becomes abutted against or separated from the flapper retraction abutment portion 403 of the flapper 40.

In the course of pulling out the fixing device from the image forming apparatus main body, as illustrated in FIG. 15A, the unit insertion link 90 is detached from the insertion link pushing-up portion 311F of the fixing device. With the above, the insertion link abutment portion 91 of the unit insertion link 90 is abutted against the flapper retraction abutment portion 403 of the flapper 40 with biasing force of a biasing member (not shown) and pushes up the flapper 40. With the above, as illustrated in FIG. 14B, the flapper 40 is retracted to the outside of the mount area 30T of the fixing device.

On the other hand, in a state in which the fixing device is mounted in the image forming apparatus main body, as illustrated in FIGS. 15B and 15C, the unit insertion link 90 is pushed up by the insertion link pushing-up portion 311F of the fixing device. With the above, the insertion link abutment portion 91 of the unit insertion link 90 is separated from the flapper retraction abutment portion 403 of the flapper 40.

Furthermore, when the fixing device is mounted in the apparatus main body, as illustrated in FIG. 16C, the flapper pushing-up portion 311R pushes up the abutment portion 402 of the flapper 40. With the above, the flapper 40 is switched to the first guiding position (the position illustrated by the broken line in FIG. 1) that guides the recording material, which has passed through the nip portion of the fixing device, in the discharge roller direction. The recording material that has passed between the nip portion of the fixing device passes through a first conveyance path between one side of the flapper 40 at the first guiding position and the fixing device sheet discharge guide 310, and is guided in the discharge roller 13 direction that is a first direction. In so doing, as illustrated in FIG. 15C, the insertion link abutment portion 91 of the unit insertion link 90 is separated from the flapper retraction abutment portion 403 of the flapper 40.

Furthermore, in a state in which the fixing device is mounted in the apparatus main body, as illustrated in FIG. 16B, the solenoid link 71 is pivoted by the solenoid 70 (see FIG. 10) and the flapper link 360 equipped in the fixing device lifts up the abutment portion 402 of the flapper 40. With the above, the flapper 40 is switched to the second guiding position (the position illustrated by the solid line in FIG. 1) that guides the recording material, which has passed through the nip portion of the fixing device, in the reversing roller direction. The recording material that has passed between the nip portion of the fixing device passes through the second conveyance path between the other side of the flapper 40 at the second guiding position and the fixing device reverse guide 311, and is guided in the reversing roller 14 direction that is the second direction. In so doing, as illustrated in FIG. 15B, the insertion link abutment portion 91 of the unit insertion link 90 is separated from the flapper retraction abutment portion 403 of the flapper 40.

Furthermore, the recording material that has been guided in the reversing roller 14 direction is conveyed in the reverse path 141 direction with the reversing roller 14 before the rear end of the recording material reaches the reversing point B illustrated in FIG. 1. After the rear end of the recording material has reached the reversing point B, the flapper 40 is switched to the first guiding position (the position illustrated by the broken line in FIG. 1). In so doing, the reversing roller 14 reverses the rotation direction so that the recording material P is conveyed in a reversed manner so that the rear end is situated at the front and so that the recording material P passes over the flapper 40 and is conveyed in the duplex conveying roller 15 direction. In so doing, as illustrated in FIG. 15C, the insertion link abutment portion 91 of the unit insertion link 90 is separated from the flapper retraction abutment portion 403 of the flapper 40.

Furthermore, in the course of dismounting the fixing device from the apparatus main body, as illustrated in FIG. 16A, the abutment portion 402 of the flapper 40 is released from the flapper pushing-up portion 311R of the fixing device. With the above, the flapper 40 can pivot to an angle at which the flapper front end portion 401 does not overlap the fixing device sheet discharge guide 310 in the direction intersecting the mounting and dismounting direction Ya and Yb (see FIG. 14B). Furthermore, in the course of dismounting the fixing device from the apparatus main body, as illustrated in FIG. 15A, the unit insertion link 90 is detached from the insertion link pushing-up portion 311F of the fixing device. With the above, the insertion link abutment portion 91 of the unit insertion link 90 is abutted against the flapper retraction abutment portion 403 of the flapper 40 with biasing force of a biasing member (not shown) and pushes up the flapper 40 that has become pivotable. In the above, as illustrated in FIG. 14B, the flapper 40 is retracted to the outside of the mount area 30T of the fixing device. In other words, the flapper front end portion 401 of the flapper 40 is retracted above the mounting and dismounting locus 310T of the uppermost point of the fixing device sheet discharge guide 310.

As illustrated in FIG. 12A, in a state in which the fixing device 30 is mounted in the image forming apparatus main body 101, the insertion link pushing-up portion 311F on the fixing device side abuts against the unit insertion link 90 on the apparatus main body side. Furthermore, the insertion link pushing-up portion 311F lifts up the unit insertion link 90 in a direction opposing the biasing force in the arrow F direction. With the above, the insertion link abutment portion 91 of the unit insertion link 90 and the flapper retraction abutment portion 403 of the flapper 40 become separated from each other, and the biasing force in the arrow F direction acting on the unit insertion link 90 is not transmitted to the flapper 40. Furthermore, in a state in which the fixing device is mounted in the apparatus main body, after the solenoid 70 has performed suction to change the position of the flapper 40 to the reversing roller 14 direction, the insertion link abutment portion 91 and the flapper retraction abutment portion 403 of the flapper 40 are disposed so as to be separated from each other. Accordingly, the biasing force in the arrow F direction acting on the unit insertion link 90 is not transmitted to the flapper 40.

With the above, since the suction force needed in the solenoid 70 is not affected by the biasing force in the arrow F direction acting on the unit insertion link 90, the size of the solenoid 70 can be kept even more small.

As illustrated in FIG. 12B, subsequently, in the course of pulling out the fixing device 30 from the apparatus main body, the unit insertion link 90 is released from the insertion link pushing-up portion 311F. Then, with the biasing force in the arrow F direction acting on the unit insertion link 90, the insertion link abutment portion 91 of the unit insertion link 90 abuts against the flapper retraction abutment portion 403 of the flapper 40 and pushes the flapper 40 up in the arrow F direction. Furthermore, the retracted position of the flapper 40 is set by having the flapper 40 abut against a discharging and reversing frame abutment portion 521 of the discharging and reversing frame 52 with the biasing force.

Figure 13:
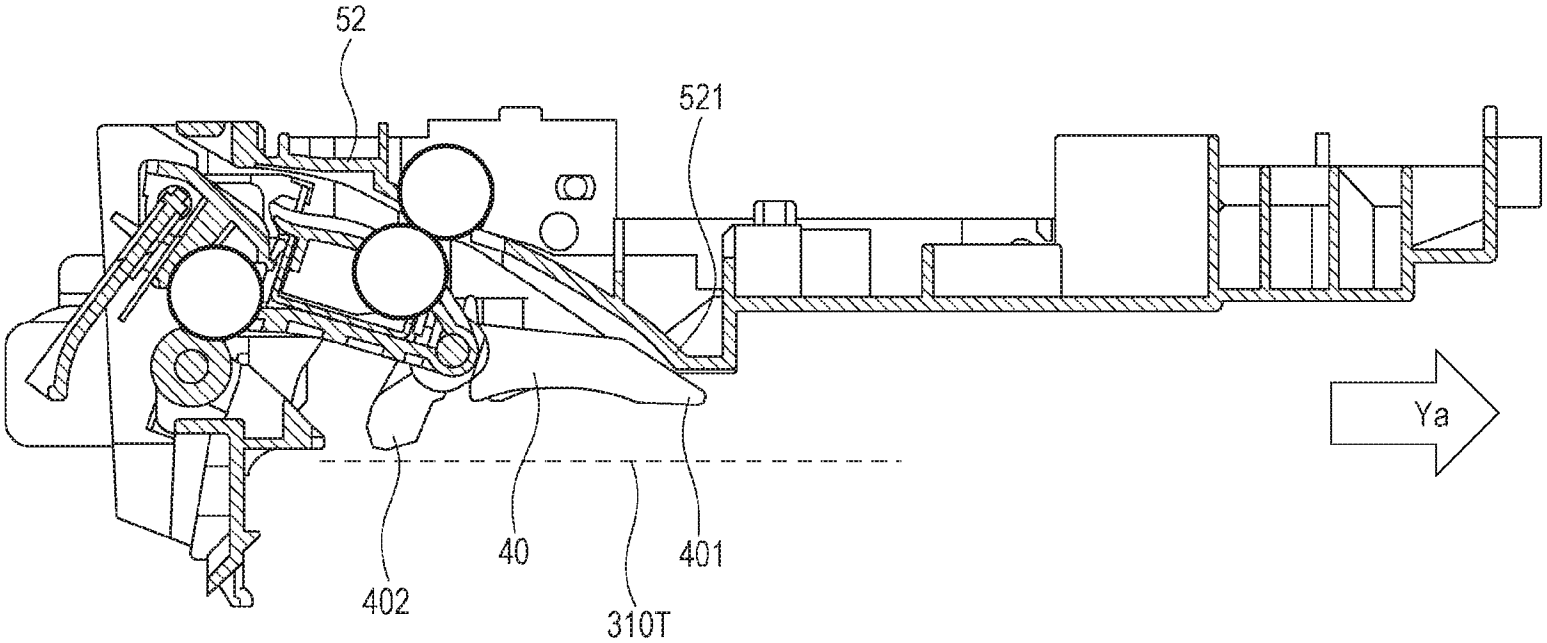
FIG. 13 is a diagram of components of the discharging and reversing unit in a state in which the fixing device has been pulled out.

The state in which the flapper 40 is in the retracted position, in other words, a state in which the fixing device 30 has been pulled out from the image forming apparatus main body 101 is illustrated in FIG. 13.

The flapper front end portion 401 of the flapper 40 is sufficiently retracted with respect to the mounting and dismounting locus 310T (illustrated in FIG. 13) of the uppermost point of the fixing device sheet discharge guide 310 in the mounting and dismounting direction Ya and Yb. In other words, the flapper 40 is retracted to the outside of the mount area 30T (see FIG. 14B) of the fixing device 30 in the apparatus main body. Accordingly, when mounting and dismounting the fixing device 30, since the flapper front end portion 401 does not hit the fixing device sheet discharge guide 310, in other words, the flapper front end portion 401 does not hit the fixing device, mounting and dismounting can be carried out in a stress less manner.

As described above, in the course of pulling out the fixing device 30 from the apparatus main body, the flapper front end portion 401 of the flapper 40 is configured to retract in the direction intersecting the mounting and dismounting direction Ya and Yb. With the above, the size and weight of the image forming apparatus can be suppressed, and replacement of the fixing device and the operation when the paper is jammed can be carried out smoothly.

In the exemplary embodiment described above, the insertion link 90 is disposed on the apparatus front side where there is relatively plenty of space to efficiently suppress the overall size of the image forming apparatus; however, the configuration is not limited to the above. For example, when there is some unused space inside the apparatus, biasing force E of the flapper 40 may be increased and the size of the solenoid 70 can be increased without providing the insertion link 90.

Furthermore, in the exemplary embodiment described above, the fixing device has been exemplified as a unit that is detachably attachable to the image forming apparatus main body; however, the configuration is not limited to the above. A similar effect can be obtained by applying the present disclosure to a configuration in which another unit (the conveyance unit, or the like) is detachably attachable to the apparatus main body and in which a flapper having a similar positional relationship as the unit described above is provided.

Furthermore, in the exemplary embodiment described above, the heating film assembly has been exemplified as the heating rotation member included in the fixing device; however, the configuration is not limited to the above. The heating rotation member may be another heating rotation member, such as a heat roller containing a heat generating element such as a heater, or may be an endless belt. Furthermore, the pressure contact roller 303 has been exemplified as the pressing rotation member included in the fixing device; however, the configuration is not limited to the above. The pressing rotation member may be another pressing rotation member such as an endless belt including a portion applying pressure to the heating rotation member.

Furthermore, in the exemplary embodiment described above, the printer has been exemplified as an image forming apparatus; however, the configuration is not limited to the above. For example, the image forming apparatus may be another image forming apparatus such as a copying machine or a facsimile machine, or a multi-functional apparatus that combines a plurality of the above functions. Similar effects can be obtained by applying the present disclosure to such image forming apparatuses.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-170879 filed Sep. 6, 2017, Japanese Patent Application No. 2018-117473 filed Jun. 20, 2018, which are hereby incorporated by reference herein in their entirety.

What is claimed is:

1. An image forming apparatus comprising:

an apparatus main body including an image forming device that forms an image on a recording material;

a unit detachably mounted in the apparatus main body;

a switching member pivotably provided in the apparatus main body, wherein while in a state in which the switching member has entered into the unit mounted in the apparatus main body, the switching member selectively switches a route through which the recording material is guided; and a retracting member provided in the apparatus main body, wherein in a course of dismounting the unit from the apparatus main body, the retracting member retracts the switching member to an outside of a mount area of the unit.

2. The image forming apparatus according to claim 1, wherein the retracting member is provided so that the retracting member can be abutted against or separated from the switching member, the retracting member being biased to a direction that retracts the switching member to the outside of the mount area of the unit, and wherein in a course of mounting the unit in the apparatus main body, the retracting member is abutted against the unit and, countering biasing force, is separated from the switching member.

3. The image forming apparatus according to claim 2, wherein in a course of dismounting the unit from the apparatus main body, the abutment between the retracting member and the unit is released, and the retracting member abuts against the switching member with the biasing force and retracts the switching member to the outside of the mount area of the unit.

4. The image forming apparatus according to claim 2, wherein in a state in which the unit is mounted in the apparatus main body, the retracting member is separated from the switching member even when the switching member has been switched.

5. The image forming apparatus according to claim 1, wherein a switching mechanism that selectively switches, in a state in which the unit is mounted in the apparatus main body, the switching member to a route through which the recording material is guided is provided separate from the retracting member.

6. The image forming apparatus according to claim 1, wherein the image forming device included in the apparatus main body is configured to form a toner image on a recording material, and the unit is a fixing device that fixes a toner image on a recording material.

7. The image forming apparatus according to claim 6, wherein the fixing device is configured to perform fixing of a toner image on a recording material by pinching and conveying the recording material with a heating rotation member and a pressing rotation member while heating the recording material.

8. The image forming apparatus according to claim 7, wherein the switching member is capable of being switched between a first guiding position that guides a recording material that has passed between the heating rotation member and the pressing rotation member to a first direction, and a second guiding position that guides the recording material to a direction different from the first direction.

9. The image forming apparatus according to claim 8, further comprising:

a discharging member provided downstream of the fixing device in a conveyance direction of a recording material, the discharging member discharging the recording material; and a reversing member provided downstream of the fixing device in the conveyance direction of the recording material, the reversing member reversing a rotation direction to convey the recording material in a reversed manner, wherein the recording material that has passed between the heating rotation member and the pressing rotation member is guided in a discharging member direction with the switching member switched to the first guiding position, and is guided in a reversing member direction with the switching member switched to the second guiding position.

10. The image forming apparatus according to claim 9, wherein in a case in which an image is formed on each of the two surfaces of the recording material, the recording material that has passed between the heating rotation member and the pressing rotation member is guided in the reversing member direction with the switching member switched to the second guiding position and, subsequently, is guided towards the image forming device once more by switching the switching member to the first guiding position and by reversing the rotation direction of the reversing member.

11. The image forming apparatus according to claim 8, wherein in a course of mounting the fixing device in the apparatus main body, a front end of the switching member enters into the fixing device, and in a state in which the fixing device is mounted in the apparatus main body, the switching member is switched from the first guiding position to the second guiding position so that an amount of the front end entering the fixing device is the largest.

* * * * *